US009588479B2

(12) United States Patent
Gohda et al.

(10) Patent No.: US 9,588,479 B2
(45) Date of Patent: Mar. 7, 2017

(54) IMAGE FORMING APPARATUS AND PROCESS CARTRIDGE

(71) Applicants: Shohei Gohda, Ishikawa (JP); Masanobu Gondoh, Kanagawa (JP); Kaori Toyama, Kanagawa (JP); Yohta Sakon, Kanagawa (JP); Masahiro Ohmori, Kanagawa (JP); Yuka Aoyama, Kanagawa (JP); Yuta Nakamura, Kanagawa (JP); Yoshihiro Moriya, Shizuoka (JP); Satoshi Kojima, Kanagawa (JP)

(72) Inventors: Shohei Gohda, Ishikawa (JP); Masanobu Gondoh, Kanagawa (JP); Kaori Toyama, Kanagawa (JP); Yohta Sakon, Kanagawa (JP); Masahiro Ohmori, Kanagawa (JP); Yuka Aoyama, Kanagawa (JP); Yuta Nakamura, Kanagawa (JP); Yoshihiro Moriya, Shizuoka (JP); Satoshi Kojima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/074,333

(22) Filed: Mar. 18, 2016

(65) Prior Publication Data

US 2016/0274527 A1 Sep. 22, 2016

(30) Foreign Application Priority Data

Mar. 19, 2015 (JP) ..... 2015-056443
Apr. 7, 2015 (JP) ..... 2015-078349

(51) Int. Cl.
*G03G 21/00* (2006.01)
*G03G 9/00* (2006.01)

(52) U.S. Cl.
CPC ..... *G03G 21/0017* (2013.01); *G03G 9/00* (2013.01)

(58) Field of Classification Search
CPC ..... G03G 21/0017; G03G 9/00
(Continued)

(56) References Cited

U.S. PATENT DOCUMENTS 9,052,631 B2 * 6/2015 Gohda et al. ..... G03G 21/0017
9,146,524 B2 * 9/2015 Gohda et al. ..... G03G 21/0017
(Continued)

FOREIGN PATENT DOCUMENTS

JP 9-127846 5/1997
JP 2004-233818 8/2004
(Continued)

*Primary Examiner* — William J Royer
(74) *Attorney, Agent, or Firm* — Oblon, McClelland, Maier & Neustadt, L.L.P.

(57) ABSTRACT

An image forming apparatus is provided which includes an image bearer, a charger to charge the image bearer, a latent image forming device to form an electrostatic latent image on the image bearer, a developing device to develop the electrostatic latent image with a toner, a transfer device to transfer the toner image onto a transfer medium, and a cleaning blade to remove residual toner particles remaining on the image bearer. The toner includes a binder resin and a release agent. The release agent has a longest length Lmax in the toner, which is equal to or greater than 1.1 times a maximum Feret diameter Df of the toner. The cleaning blade includes a strip-like elastic body blade having a contact part with the image bearer. The contact part includes a cured product of an ultraviolet curable composition including an acrylate or methacrylate compound having an alicyclic structure.

12 Claims, 9 Drawing Sheets

(58) Field of Classification Search
USPC ..... 399/346, 350
See application file for complete search history.

(56) References Cited

U.S. PATENT DOCUMENTS

| | | | | |
|---|---|---|---|---|
| 9,310,751 | B2 * | 4/2016 | Shimizu et al. ... | G03G 21/0017 |
| 2014/0178103 | A1 | 6/2014 | Gohda et al. | |
| 2015/0023707 | A1 | 1/2015 | Gohda et al. | |
| 2015/0139711 | A1 | 5/2015 | Gohda et al. | |

FOREIGN PATENT DOCUMENTS

| | | |
|---|---|---|
| JP | 2009-134061 | 6/2009 |
| JP | 2009-294492 | 12/2009 |
| JP | 2010-152295 | 7/2010 |
| JP | 2012-083729 | 4/2012 |
| JP | 2014-142597 | 8/2014 |
| JP | 2015-022036 | 2/2015 |
| JP | 2015-096890 | 5/2015 |
| JP | 2015-158633 | 9/2015 |

* cited by examiner

IMAGE FORMING APPARATUS AND PROCESS CARTRIDGE

CROSS-REFERENCE TO RELATED APPLICATIONS

This patent application is based on and claims priority pursuant to 35 U.S.C. §119(a) to Japanese Patent Application Nos. 2015-056443 and 2015-078349, filed on Mar. 19, 2015 and Apr. 7, 2015, respectively, in the Japan Patent Office, the entire disclosure of each of which is hereby incorporated by reference herein.

BACKGROUND

Technical Field

The present disclosure relates to an image forming apparatus and a process cartridge.

Description of the Related Art

In a typical electrophotographic image forming apparatus, residual toner particles remaining on a photoconductor or image bearer without being transferred onto a transfer sheet or intermediate transfer medium are removed by a cleaner. The cleaner generally contains a cleaning blade having a strip-like shape for its simple configuration and excellent cleaning ability. Such a cleaning blade is typically composed of an elastic body blade having a strip-like shape which may be made of polyurethane rubber.

The cleaning blade is configured to hold and scrape off residual toner particles remaining on the image bearer to remove them from the image bearer while the base end of the elastic body blade is supported by a support and the tip ridgeline part of the elastic body blade is pressed against the peripheral surface of the image bearer.

When the elastic body blade, which may be made of polyurethane rubber, is brought into contact with the image bearer to clean the image bearer, the tip of the blade is pulled in the direction of movement of the image bearer due to the frictional force generated between the image bearer and the cleaning blade, thereby causing stick-slip motion. If the image bearer is cleaned during the occurrence of stick-slip motion, toner particles will pass through between the elastic body blade and the image bearer, resulting in defective cleaning. In addition, toner particles or external additives thereof will be rubbed against the image bearer to be firmly adherent to the image bearer.

On the other hand, the toner typically contains a release agent. In a case in which the release agent is positioned near the surface of the toner for the purpose of accelerating exposure of the release agent, the occurrence of offset phenomenon can be prevented, but the release agent may become adherent to other members while the toner is being stirred in a developing device. The toner may be pressed against carrier particles or photoconductors and become firmly adherent thereto. This phenomenon is hereinafter referred to as filming. The filming phenomenon is likely to deteriorate developability.

Thus, the release agent should be protected inside the toner when the toner is being stirred or stored. At the same time, the release agent should be efficiently exposed at the surface of the toner to express releasability from the fixing member in such a short time during which the toner passes through the fixing member.

Many attempts have been made to determine a proper dispersion particle diameter for the release agent dispersed in the toner for preventing the occurrence of the offset problem while maintaining toner productivity. It is generally very difficult to contain the wax in the form of fine particles inside the toner without exposing them at the surface of the toner because the wax particles are inevitably finer than the toner particles.

From the standpoint of giving resistance to the offset phenomenon (hereinafter "hot offset resistance") to the toner, it is more effective that the release agent exists in the form of a relatively large block rather than in the form of fine particles locally distributed over the toner. If the release agent in the form of a large block is achieved by excessively increasing the content of the release agent, the toner will deteriorate in strength and become easy to get crushed, deteriorating resistance to the filming phenomena.

Accordingly, there has been a demand for a toner which achieves a good combination of filming resistance and offset resistance with using a small amount of release agent.

SUMMARY

In accordance with some embodiments of the present invention, an image forming apparatus is provided. The image forming apparatus includes an image bearer, a charger to charge a surface of the image bearer, a latent image forming device to form an electrostatic latent image on the charged surface of the image bearer, a developing device to develop the electrostatic latent image into a toner image with a toner, a transfer device to transfer the toner image from the surface of the image bearer onto a transfer medium, and a cleaner including a cleaning blade to remove residual toner particles remaining on the surface of the image bearer by contact with the surface of the image bearer. The toner includes a binder resin and a release agent. The release agent has a longest length Lmax in the toner, and the longest length Lmax is equal to or greater than 1.1 times a maximum Feret diameter Df of the toner. The cleaning blade includes an elastic body blade having a strip-like shape. The elastic body blade has a contact part to contact the surface of the image bearer. The contact part includes a cured product of an ultraviolet curable composition including an acrylate or methacrylate compound having an alicyclic structure.

In accordance with some embodiments of the present invention, a process cartridge detachably mountable on image forming apparatus is provided. The process cartridge includes an image bearer, a developing device to develop an electrostatic latent image formed on a surface of the image bearer into a toner image with a toner, and a cleaner including a cleaning blade to remove residual toner particles remaining on the surface of the image bearer by contact with the surface of the image bearer. The toner includes a binder resin and a release agent. The release agent has a longest length Lmax in the toner, and the longest length Lmax is equal to or greater than 1.1 times a maximum Feret diameter Df of the toner. The cleaning blade includes an elastic body blade having a strip-like shape. The elastic body blade has a contact part to contact the surface of the image bearer. The contact part includes a cured product of an ultraviolet curable composition including an acrylate or methacrylate compound having an alicyclic structure.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
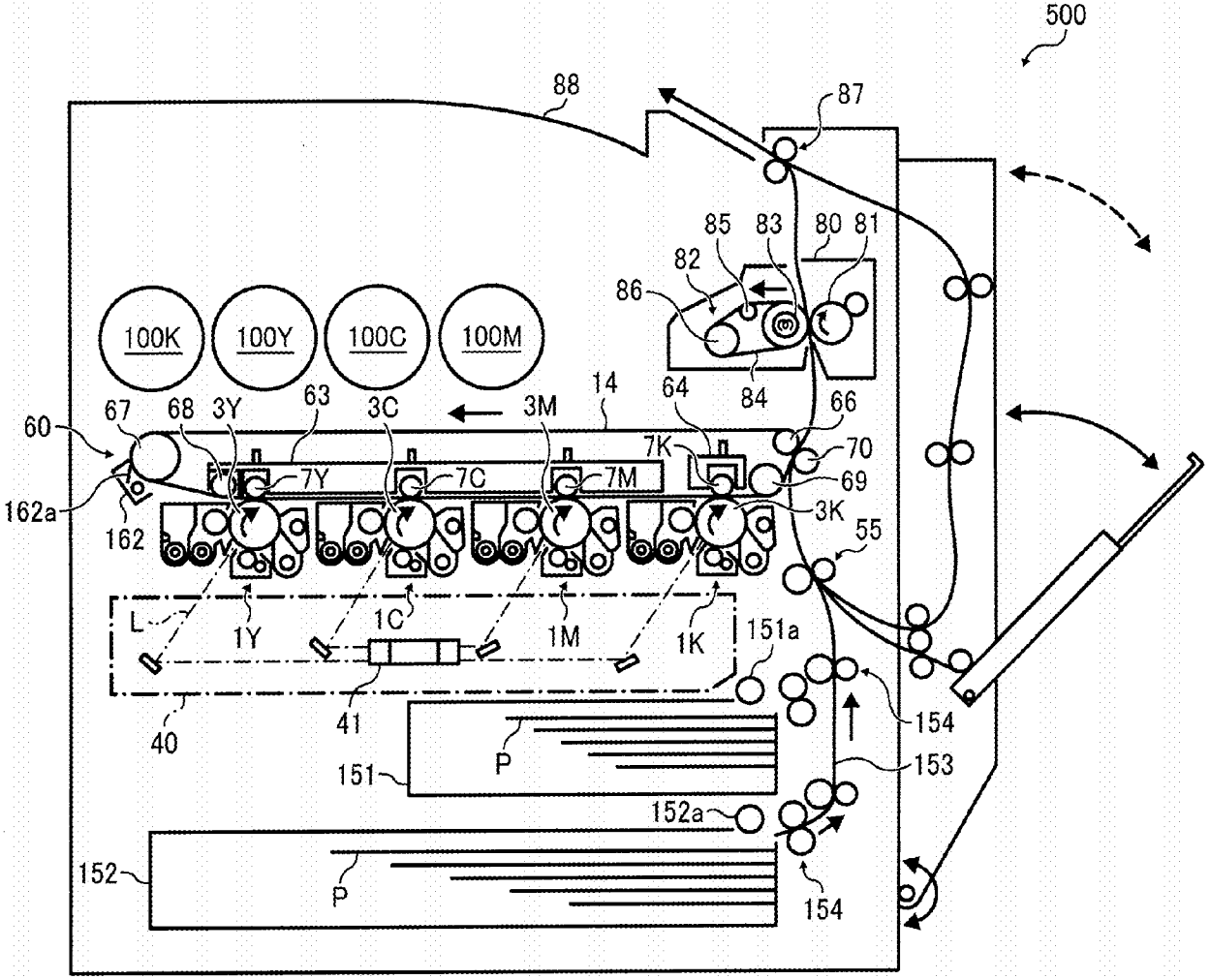
FIG. 1 is a schematic view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

In accordance with some embodiments of the present invention, an image forming apparatus which prevents the occurrence of stick-slip motion of the cleaning blade to suppress defective cleaning of the image bearer and formation of adhered matter on the image bearer is provided.

In accordance with some embodiments of the present invention, an image forming apparatus which has a good combination of offset resistance and filming resistance and is capable of providing high-definition high-quality image for an extended period of time is provided.

The inventors of the present invention have found that an image forming apparatus which includes a specific cleaning blade and a specific toner can solve the above-described problems. Specifically, the specific cleaning blade includes an elastic body blade having a contact portion to contact the surface of the image bearer, and the contact portion includes a cured product of an ultraviolet curable composition including an acrylate or methacrylate compound having an alicyclic structure. The specific toner includes a binder resin and a release agent, and the release agent has a longest length Lmax in the toner being equal to or greater than 1.1 times a maximum Feret diameter Df of the toner.

An image forming apparatus according to an embodiment of the present invention includes an image bearer, a charger to charge a surface of the image bearer, a latent image forming device to form an electrostatic latent image on the charged surface of the image bearer, a developing device to develop the electrostatic latent image into a toner image with a toner, a transfer device to transfer the toner image from the surface of the image bearer onto a transfer medium, and a cleaner including a cleaning blade to remove residual toner particles remaining on the surface of the image bearer by contact with the surface of the image bearer.

Examples of the image forming apparatus include an electrophotographic printer. Examples of the electrophotographic printer include a printer 500 described below.

FIG. 1 is a schematic view of the printer 500. The printer 500 includes four image forming units 1Y, 1C, 1M, and 1K for forming yellow images, cyan images, magenta images, and black images, respectively. The image forming units 1Y, 1C, 1M, and 1K have the same configuration except for containing different-color toners, i.e., yellow toner, cyan toner, magenta toner, and black toner, respectively.

Above the four image forming units 1Y, 1C, 1M, and 1K (each hereinafter referred to as "image forming unit 1" for the sake of simplicity), a transfer unit 60 including an intermediate transfer belt 14, serving as an intermediate transfer medium, is disposed. Toner images of yellow, cyan, magenta, and black are formed on respective photoconductors 3Y, 3C, 3M, and 3K, each serving as the image bearer, included in the respective image forming units 1Y, 1C, 1M, and 1K. The toner images of yellow, cyan, magenta, and black are superimposed on one another on a surface of the intermediate transfer belt 14.

Below the four image forming units 1, an optical writing unit 40 is disposed. The optical writing unit 40, serving as the latent image forming device, emits laser light L to the photoconductors 3Y, 3C, 3M, and 3K based on image information. Thus, electrostatic latent images of yellow, cyan, magenta, and black are formed on the photoconductors 3Y, 3C, 3M, and 3K, respectively. Specifically, in the optical writing unit 40, the laser light L is emitted from a light source and directed toward the photoconductors 3Y, 3C, 3M, and 3K through multiple optical lenses and mirrors while being deflected by a polygon mirror 41 rotary-driven by a motor. Alternatively, the optical writing unit 40 can be replaced with another unit in which LED array performs optical scanning.

Below the optical writing unit 40, a first sheet tray 151 and a second sheet tray 152 are disposed overlapping with each other in the vertical direction. Each of the first sheet tray 151 and the second sheet tray 152 stores a paper bundle in which multiple transfer sheets P, serving as recording media, are stacked. The transfer sheet P at the top of the bundle in each of the first sheet tray 151 and the second sheet tray 152 is in contact with a first sheet feeding roller 151*a* and a second sheet feeding roller 152*a*, respectively. As the first sheet feeding roller 151*a* is driven to rotate counterclockwise in FIG. 1 by a driver, the top transfer sheet P in the first sheet tray 151 is ejected toward a sheet feeding path 153 disposed on the right side of the first sheet tray 151 extending in the vertical direction in FIG. 1. As the second sheet feeding roller 152*a* is driven to rotate counterclockwise in FIG. 1 by a driver, the top transfer sheet P in the second sheet tray 152 is ejected toward the sheet feeding path 153.

Inside the sheet feeding path 153, multiple conveyance roller pairs 154 are disposed. The transfer sheet P is conveyed inside the sheet feeding path 153 upward in FIG. 1 while being sandwiched between the rollers of the conveyance roller pairs 154.

On a downstream end of the sheet feeding path 153 relative to the direction of conveyance of the transfer sheet P, a registration roller pair 55 is disposed. Upon sandwiching of the transfer sheet P fed from the conveyance roller pairs 154, the registration roller pair 55 stops rotating. The registration roller pair 55 then timely feeds the transfer sheet P toward a secondary transfer nip, to be described later.

Figure 2:
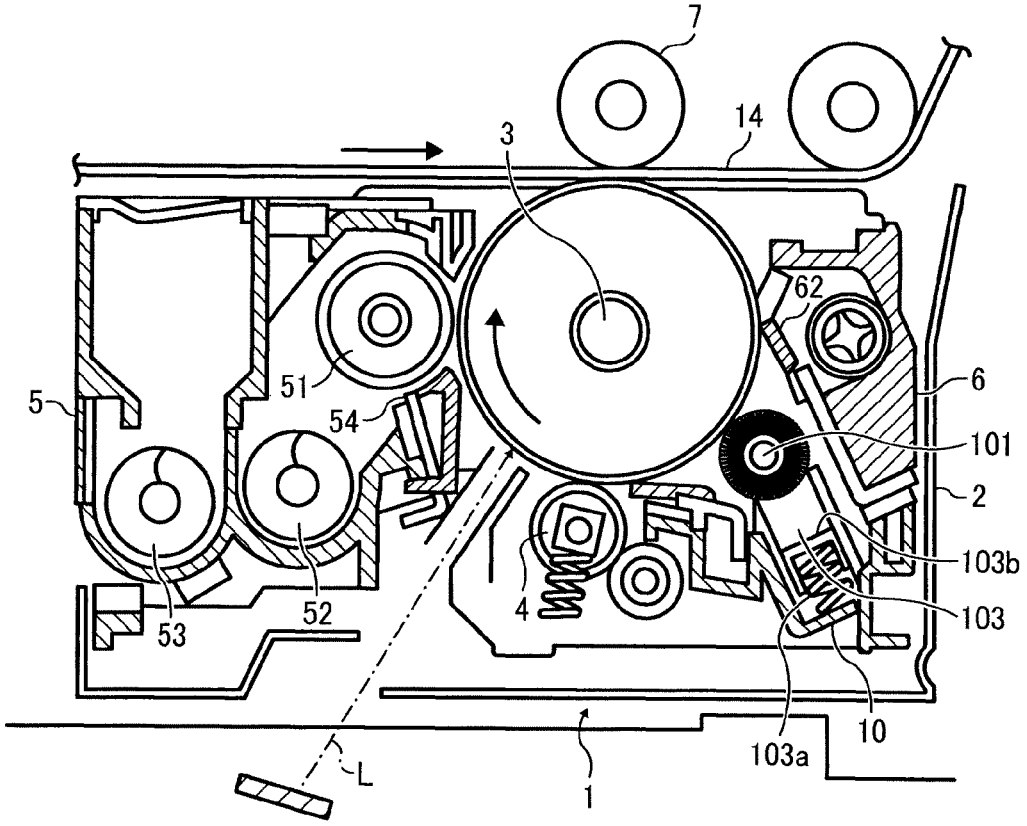
FIG. 2 is a schematic view of an image forming unit in the image forming apparatus illustrated in FIG. 1.

FIG. 2 is a schematic view of the image forming unit 1.

The image forming unit 1 includes the photoconductor 3 (i.e., the photoconductor 3Y, 3C, 3M, or 3K) in a drum-like shape, serving as the image bearer. According to another embodiment, the photoconductor 3 may be in a sheet-like or endless-belt-like shape.

Around the photoconductor 3, a charging roller 4, a developing device 5, a primary transfer roller 7, a cleaner 6, a lubricant applicator 10, and a neutralization lamp are disposed. The charging roller 4 serves as a charging member of the charger. The developing device 5 develops a latent image formed on a surface of the photoconductor 3 into a toner image. The primary transfer roller 7 transfers the toner image from the surface of the photoconductor 3 onto the intermediate transfer belt 14. The cleaner 6 removes residual toner particles remaining on the photoconductor 3 after the toner image has been transferred therefrom onto the intermediate transfer belt 14. The lubricant applicator 10 applies a lubricant to the surface of the photoconductor 3 having been cleaned with the cleaner 6. The neutralization lamp neutralizes the surface potential of the photoconductor 3 having been cleaned.

The charging roller 4 is disposed at a distance from the photoconductor 3 without contacting the photoconductor 3. The charging roller 4 charges the photoconductor 3 to a predetermined potential with a predetermined polarity. After the charging roller 4 has uniformly charged a surface of the photoconductor 3, the optical writing unit 40 emits the laser light L to the charged surface of the photoconductor 3 based on image information to form an electrostatic latent image.

The developing device 5 includes a developing roller 51 serving as a developer bearer. A developing bias is applied from a power source to the developing roller 51. Inside the casing of the developing device 5, a supply screw 52 and a stirring screw 53 are disposed. The supply screw 52 and the stirring screw 53 convey a developer stored in the casing in opposite directions to stir the developer. A doctor 54 is also disposed inside the casing. The doctor 54 regulates the developer carried on the developing roller 51. As the developer is conveyed and stirred by the supply screw 52 and the stirring screw 53, toner particles in the developer are charged to have a predetermined polarity. The developer is then drawn up on the surface of the developing roller 51 and regulated by the doctor 54. The toner particles in the developer become adherent to the latent image on the photoconductor 3, in a developing region where the developing roller 51 is facing the photoconductor 3.

The cleaner 6 includes a fur brush 101 and a cleaning blade 62. The cleaning blade 62 is in contact with the photoconductor 3 while facing in the direction of surface movement of the photoconductor 3. Details of the cleaning blade 62 are described later.

The lubricant applicator 10 includes a solid lubricant 103 and a lubricant pressing spring 103*a*. The solid lubricant 103 is applied to the photoconductor 3 by the fur brush 101, serving as an application brush. The solid lubricant 103 is held by a bracket 103*b* and is pressurized toward the fur brush 101 side by the lubricant pressing spring 103*a*. The fur brush 101 rotates in the direction trailing rotation of the photoconductor 3, thereby scraping off the solid lubricant 103 and applying that to the photoconductor 3. Owing to application of the lubricant to the photoconductor 3, the surface friction coefficient of the photoconductor 3 is maintained at 0.2 or less during non-image forming periods.

In the present embodiment, a non-contact closely-positioned charger, in which the charging roller 4 is disposed in proximity to the photoconductor 3 without contacting the photoconductor 3, is employed as the charger. Alternatively, any known charger such as corotron, scorotron, and solid state charger can also be used. Specifically, contact chargers and non-contact closely-positioned chargers are preferable since they have advantages of high charging efficiency, less ozone generation, and compact size.

Examples of the light sources in the optical writing unit 40 and the neutralization lamp include all luminous matters. Specific examples of the light sources include, but are not limited to, fluorescent lamp, tungsten lamp, halogen lamp, mercury lamp, sodium-vapor lamp, light-emitting diode (LED), laser diode (LD), and electroluminescence (EL).

For the purpose of emitting light having a desired wavelength only, any type of filter can be used, such as sharp cut filter, band pass filter, near infrared cut filter, dichroic filter, interference filter, and color-temperature conversion filter.

Among the above light sources, light-emitting diode (LED) and laser diode (LD) are preferable since they provide high emission energy with long-wavelength light having a wavelength of from 600 to 800 nm.

The transfer unit 60 further includes a belt cleaning unit 162, a first bracket 63, and a second bracket 64. The transfer unit 60 further includes four primary transfer rollers 7Y, 7C, 7M, and 7K, a secondary transfer backup roller 66, a driving roller 67, an auxiliary roller 68, and a tension roller 69. The intermediate transfer belt 14 is stretched taut with these eight rollers and is rotary-driven by the driving roller 67 to endlessly move counterclockwise in FIG. 1. The primary transfer rollers 7Y, 7C, 7M, and 7K and the respective photoconductors 3Y, 3C, 3M, and 3K are sandwiching the intermediate transfer belt 14 to form respective primary transfer nips therebetween. A transfer bias having the opposite polarity to the toner (e.g., positive polarity) is applied to the back surface (i.e., inner peripheral surface of the loop) of the intermediate transfer belt 14. As the intermediate transfer belt 14 endlessly moves while sequentially passing the primary transfer nips of yellow, cyan, magenta, and black, the toner images of yellow, cyan, magenta, and black formed on the respective photoconductors 3Y, 3C, 3M, and 3K are superimposed on one another on the outer peripheral surface of the intermediate transfer belt 14. Thus, a composite toner image in which four-color toner images are superimposed on one another is formed on the intermediate transfer belt 14.

The secondary transfer backup roller 66 and a secondary transfer roller 70, disposed outside the loop of the intermediate transfer belt 14, are sandwiching the intermediate transfer belt 14 to form a secondary transfer nip therebetween. The registration roller pair 55 feeds the transfer sheet P to the secondary transfer nip in synchronization with an entry of the composite toner image on the intermediate transfer belt 14 into the secondary transfer nip. The composite toner image is secondarily transferred onto the transfer sheet P in the secondary transfer nip by the actions of a secondary transfer electric field and the nip pressure. The secondary transfer electric field is formed between the secondary transfer roller 70, to which a secondary transfer bias is applied, and the secondary transfer backup roller 66. The composite toner image is combined with the white color of the transfer sheet P to become a full-color toner image.

On the intermediate transfer belt 14 having passed through the secondary transfer nip, residual toner particles having not been transferred onto the transfer sheet P are remaining. These residual toner particles are removed by the belt cleaning unit 162. The belt cleaning unit 162 includes a belt cleaning blade 162*a* in contact with the outer peripheral surface of the intermediate transfer belt 14. The belt cleaning blade 162*a* scrapes off the residual toner particles from the intermediate transfer belt 14.

The first bracket 63 of the transfer unit 60 is swingable about the rotation axis of the auxiliary roller 68 at a predetermined angle in accordance with on/off driving operation of a solenoid. When the printer 500 is to form a black-and-white image, the first bracket 63 is slightly rotated counterclockwise in FIG. 1 by driving the solenoid. This rotation of the first bracket 63 makes the primary transfer rollers 7Y, 7C, and 7M revolve counterclockwise in FIG. 1 about the rotation axis of the auxiliary roller 68 to bring the intermediate transfer belt 14 away from the photoconductors 3Y, 3C, and 3M. Thus, only the image forming unit 1K for black image is brought into operation to form a black-and-white image. Since unnecessary driving of the image forming units 1Y, 1C, and 1M is suppressed during formation of black-and-white image, undesired deterioration of compositional members of the image forming units 1Y, 1C, and 1M can be prevented.

Above the secondary transfer nip, a fixing unit 80 is disposed. The fixing unit 80 includes a pressure heating roller 81 and a fixing belt unit 82. The pressure heating roller 81 contains a heat source, such as a halogen lamp, inside. The fixing belt unit 82 includes a fixing belt 84, serving as a fixing member, a heating roller 83, a tension roller 85, a driving roller 86, and a temperature sensor. The heating roller 83 contains a heat source, such as a halogen lamp, inside. The fixing belt 84, in an endless-belt-like form, is stretched taut with the heating roller 83, the tension roller 85, and the driving roller 86, and is endlessly moved counterclockwise in FIG. 1. The fixing belt 84 is heated from its back surface side by the heating roller 83 while endlessly moving. At a position where the fixing belt 84 is wound around the heating roller 83, the pressure heating roller 81 is contacting the outer peripheral surface of the fixing belt 84. The pressure heating roller 81 is driven to rotate clockwise in FIG. 1. Thus, the pressure heating roller 81 and the fixing belt 84 form a fixing nip therebetween.

The temperature sensor is disposed outside the loop of the fixing belt 84 facing the outer peripheral surface of the fixing belt 84 forming a predetermined gap therebetween. The temperature sensor detects the surface temperature of the fixing belt 84 immediately before entering into the fixing nip. The detection result is transmitted to a fixing power supply circuit. The fixing power supply circuit on/off controls power supply to the heat sources contained in the heating roller 83 and the pressure heating roller 81 based on the detection result.

The transfer sheet P, having passed though the secondary transfer nip, is then separated from the intermediate transfer belt 14 and fed to the fixing unit 80. The transfer sheet P is fed upward in FIG. 1 while being sandwiched by the fixing nip. During this process, the transfer sheet P is heated and pressurized by the fixing belt 84, and the full-color toner image is fixed on the transfer sheet P.

The transfer sheet P having the fixed image thereon is passed through an ejection roller pair 87 and ejected outside the printer 500. On the top surface of the housing of the printer 500, a stack part 88 is formed. The transfer sheets P ejected by the ejection roller pair 87 are successively stacked on the stack part 88.

Above the transfer unit 60, four toner cartridges 100Y, 100C, 100M, and 100K, storing yellow toner, cyan toner, magenta toner, and black toner, respectively, are disposed. The yellow, cyan, magenta, and black toners in the respective toner cartridges 100Y, 100C, 100M, and 100K are supplied to the respective developing devices 5Y, 5C, 5M, and 5K in the respective image forming units 1Y, 1C, 1M, and 1K. The toner cartridges 100Y, 100C, 100M, and 100K are detachably mountable on the printer main body independent from the image forming units 1Y, 1C, 1M, and 1K.

An image forming operation of the printer 500 is described below.

Upon receipt of a print execution signal from an operation part, a predetermined voltage or current is sequentially applied to each of the charging roller 4 and the developing roller 51 at a predetermined timing. Similarly, a predetermined voltage or current is sequentially applied to each light source in the optical writing unit 40 and the neutralization lamp at a predetermined timing. At the same time, the photoconductor 3 is driven to rotate clockwise in FIG. 1 or 2 by a photoconductor driving motor.

As the photoconductor 3 rotates clockwise in FIG. 1 or 2, the surface of the photoconductor 3 is uniformly charged to a predetermined potential by the charging roller 4. The optical writing unit 40 emits the laser light L to the charged surface of the photoconductor 3 based on image information. A part on the photoconductor 3 to which the laser light L is emitted is neutralized, thereby forming an electrostatic latent image.

The surface of the photoconductor 3 having the electrostatic latent image thereon is rubbed by a magnetic brush formed of the developer on the developing roller 51 at a position where the photoconductor 3 is facing the developing device 5. Negatively-charged toner particles on the developing roller 51 migrate to the electrostatic latent image side by the action of a developing bias applied to the developing roller 51, thereby developing the electrostatic latent image into a toner image. This image forming process is performed in each of the image forming units 1Y, 1C, 1M, and 1K to form yellow, cyan, magenta, and black toner images on the photoconductors 3Y, 3C, 3M, and 3K, respectively.

Thus, in the printer 500, the developing device 5 develops the electrostatic latent image formed on the photoconductor 3 with negatively-charged toner particles by means of reversal development. In the present embodiment, an N/P (negative/positive) developing method (in that toner particles attach to low-potential areas) and a non-contact charging roller method are employed. However, the developing method and charging method are not limited thereto.

The toner images of yellow, cyan, magenta, and black formed on the respective photoconductors 3Y, 3C, 3M, and 3K are primarily transferred onto the surface of the intermediate transfer belt 14 in such a manner that they are superimposed on one another. Thus, a composite toner image is formed on the intermediate transfer belt 14.

The composite toner image (hereinafter "toner image" for simplicity) formed on the intermediate transfer belt 14 is transferred onto the transfer sheet P which has been fed from the first sheet tray 151 or second sheet tray 152, passed through the registration roller pair 55, and fed to the secondary transfer nip. The transfer sheet P is once stopped by being sandwiched by the registration roller pair 55, and then fed to the secondary transfer nip in synchronization with an entry of the leading edge of the toner image on the intermediate transfer belt 14 into the secondary transfer nip. The transfer sheet P having the transferred toner image thereon is then separated from the intermediate transfer belt 14 and fed to the fixing unit 80. As the transfer sheet P having the transferred toner image thereon is passed through the fixing unit 80, the toner image is fixed on the transfer sheet P by heat and pressure. The transfer sheet P having the fixed toner image thereon is ejected outside the printer 500 and stacked at the stack part 88.

On the other hand, after the toner image has been transferred from surface of the intermediate transfer belt 14 onto the transfer sheet P in the secondary transfer nip, the belt cleaning unit 162 removes residual toner particles remaining on the surface of the intermediate transfer belt 14.

Similarly, after the toner image has been transferred from the surface of the photoconductor 3 onto the intermediate transfer belt 14 in the primary transfer nip, the cleaner 6 removes residual toner particles remaining on the surface of the photoconductor 3. The lubricant applicator 10 then applies a lubricant to the cleaned surface and the neutralization lamp further neutralizes the surface.

A process cartridge according to an embodiment of the present invention integrally supports an image bearer, a developing device to develop an electrostatic latent image formed on a surface of the image bearer into a toner image with a toner, and a cleaner including a cleaning blade to remove residual toner particles remaining on the surface of the image bearer by contact with the surface of the image bearer. The process cartridge is detachably mountable on image forming apparatus body.

As illustrated in FIG. 2, the image forming unit 1 of the printer 500 has a frame body 2 storing the photoconductor 3 and processing means including the charging roller 4, the developing device 5, the cleaner 6, and the lubricant applicator 10. The image forming unit 1 is temporarily detachable from the main body of the printer 500 as the process cartridge. Thus, in the printer 500, the photoconductor 3 and the processing means are integrally replaceable as the process cartridge. Alternatively, the printer 500 may take a configuration in which each of the photoconductor 3, the charging roller 4, the developing device 5, the cleaner 6, and the lubricant applicator 10 is independently replaceable.

The toner according to an embodiment of the present invention is described in detail below.

The toner includes a binder resin and a release agent. The release agent has a longest length Lmax in the toner. The longest length Lmax is equal to or greater than 1.1 times a maximum Feret diameter Df of the toner.

The longest length Lmax of the release agent in the toner and the maximum Feret diameter Df of the toner can be determined from a cross-sectional image of the toner obtained by a transmission electron microscope (TEM) in the following manner.

Before the TEM observation, the toner is embedded in an epoxy resin and cut into ultrathin sections with an ultramicrotome (ultrasonic). The ultrathin sections are observed with a transmission electron microscope at a magnification where Df and Lmax are measurable, and fifty randomly-selected cross-sectional surfaces of the toner are sampled. The images of the sampled cross-sectional surfaces are analyzed by a software program ImageJ and subjected to a measurement of Lmax and Df.

Lmax represents the longest length of the release agent among the release agent domains included in each cross-sectional surface.

A value Lmax/Df is determined with respect to each of the fifty cross-sectional surfaces. In accordance with some embodiments of the present invention, the average of the fifty Lmax/Df values is 1.1 or more.

Figure 3A:
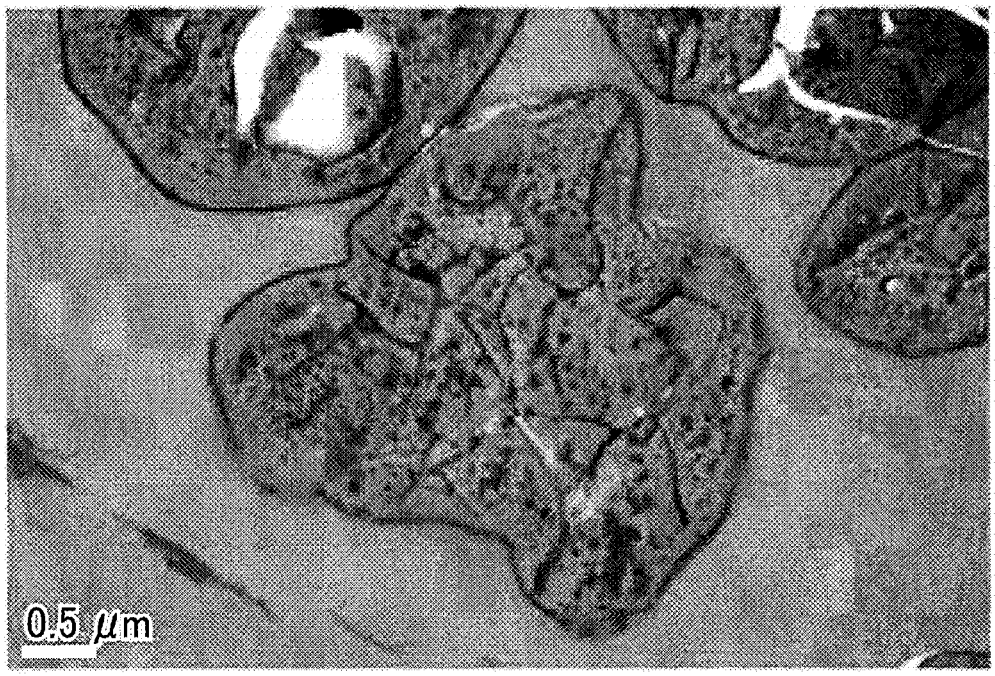
FIG. 3A is a photograph of a cross-sectional surface of a toner according to an embodiment of the present invention, obtained by transmission electron microscope (TEM)

FIG. 3A is a photograph of a cross-sectional surface of the toner obtained by TEM. Prior to the TEM observation, the ultrathin sections are dyed with ruthenium and/or osmium so as to enhance contrast of the release agent domains in the toner to efficiently determine Lmax. The longest length Lmax is determined using the multi-point selection function of ImageJ by plotting the central parts of the release agent domain and totaling the distances between the plots.

Figure 3B:
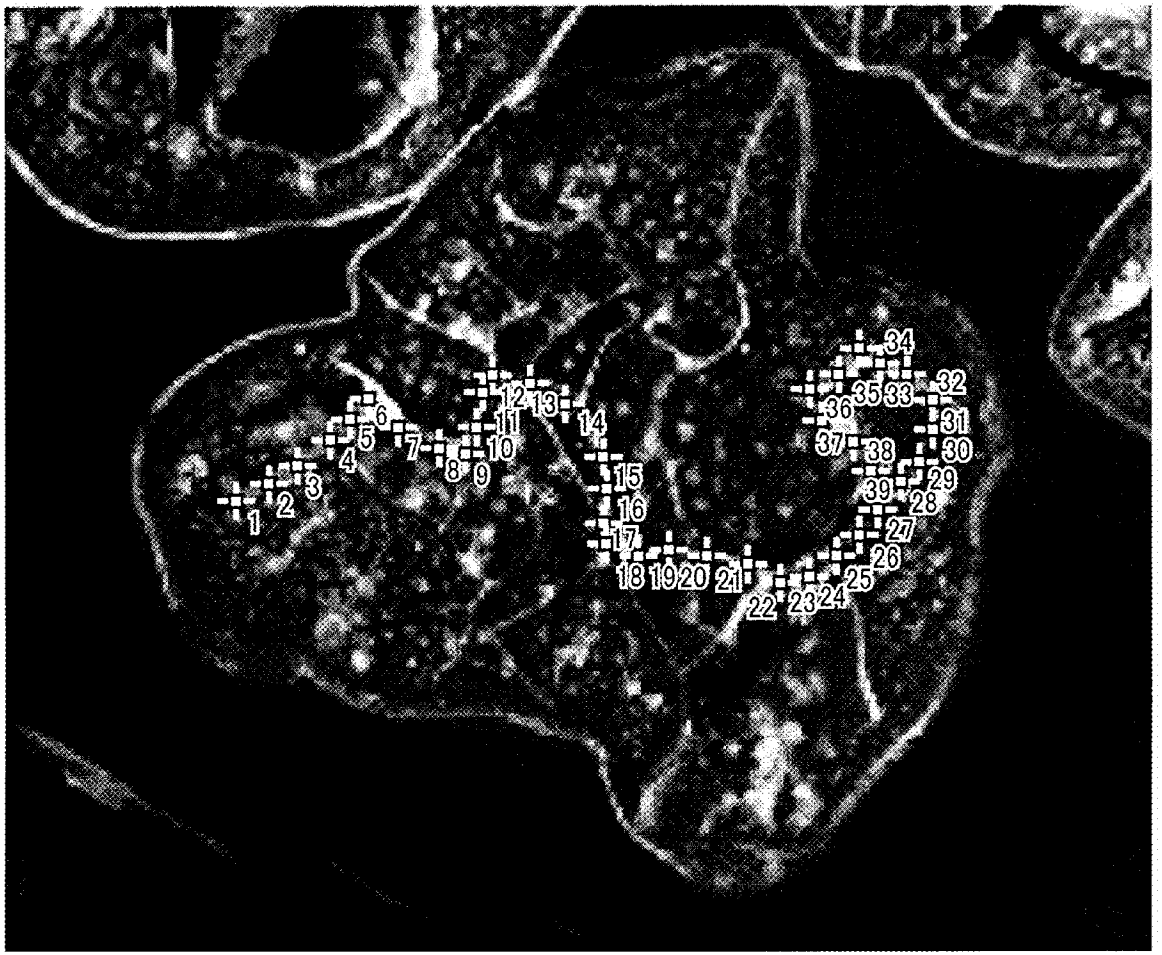
FIG. 3B is a contrast inversion image of the photograph shown in FIG. 3A.

FIG. 3B is a contrast inversion image of the photograph shown in FIG. 3A. The contrast of release agent domains is more enhanced and the central parts of the release agent domain are plotted. This image can be further binarized, if necessary. Any imaging process can be employed for the purpose of clarifying the state of the release agent. In FIG. 3B, the 1st to 39th plots are illustrated.

In accordance with some embodiments of the present invention, the longest length Lmax of the release agent domain is equal to or greater than 1.1 times the maximum Feret diameter Df of the toner particle in which the release agent domain is contained. When Lmax is less than 1.1 times Df, it is difficult for both ends of the release agent domain to be positioned at the surface of the toner particle. Thus, the release agent cannot smoothly exude from the toner particle and the offset phenomenon may be caused in the fixing process.

More preferably, the longest length Lmax of the release agent domain is from 1.2 to 1.6 times the maximum Feret diameter Df of the toner particle in which the release agent domain is contained.

Figure 4:
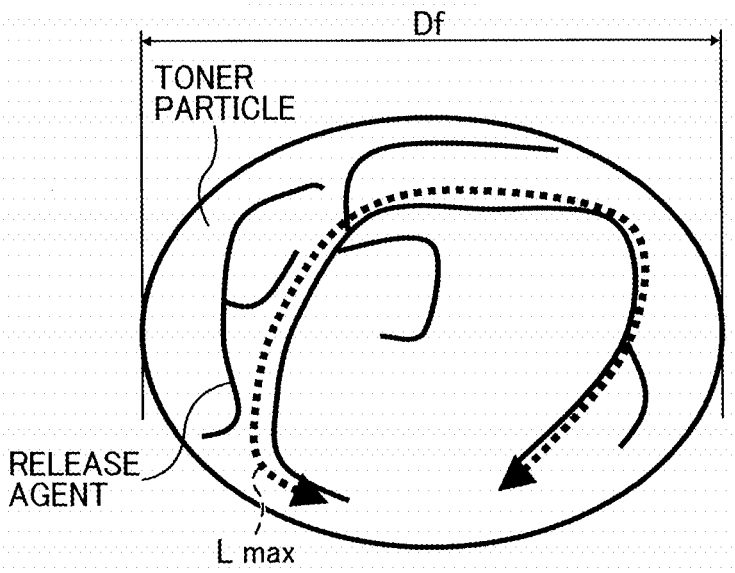
FIG. 4 is an illustration for explaining how to measure the maximum Feret diameter Df of a toner particle and the longest length Lmax of a release agent domain in the toner particle.

FIG. 4 is an illustration for explaining how to measure the maximum Feret diameter Df of a toner particle and the longest length Lmax of a release agent domain in the toner particle.

Referring to FIG. 4, the maximum Feret diameter Df is defined as the maximum distance between two parallel lines tangent to the outer periphery of the toner particle observed by TEM. The longest length Lmax is defined as the maximum distance between both ends of the release agent domain existing in one toner particle.

Preferably, the release agent is a wax, and the content rate of the wax in the toner, determined by converting an endothermic quantity of the wax measured by differential scanning calorimetry (DSC) into the mass of the wax, ranges from 1% to 20% by mass. In addition, the abundance ratio of the wax in a surface region of the toner, measured by attenuated total reflection Fourier transform infrared spectroscopy (ATR-FTIR), preferably ranges from 0.1% to 0.4% by mass, when the surface region is extending from the surface of the toner to a depth of 0.3 μm.

How to measure the amount of the wax is described in detail below.

The total amount of the wax in the toner is measured by a differential scanning calorimetry (DSC). The toner and the wax alone are each subjected to a measurement of endothermic quantity under the following conditions.

Measuring device: Differential scanning calorimeter (DSC60 from Shimadzu Corporation)

Amount of sample: About 5 mg

Temperature rising rate: 10° C./min

Measuring range: From room temperature to 150° C.

Measuring environment: In nitrogen gas atmosphere

The total amount of the wax is calculated from the following formula (I).

$$\text{Total Amount of Wax (\% by mass)} = (\text{Endothermic Quantity of Wax in Toner (J/g)} \times 100)/(\text{Endothermic Quantity of Wax Alone (J/g)}) \quad \text{(I)}$$

Even in the case in which the wax has outflowed in the toner production process and not all the raw-material wax has been incorporated in the resulting toner, the total amount of the wax contained in the resulting toner can be effectively determined by the above procedure.

The amount of the wax existing at the surface of the toner is measured by an attenuated total reflection Fourier transform infrared spectroscopy (ATR-FTIR). According to the measurement principle of ATR-FTIR, the measuring depth is about 0.3 μm. Thus, the amount of the wax existing in a region ranging from the surface to 0.3 μm in depth of the toner can be measured. The measuring procedure is as follows.

First, 3 g of the toner is pressed with a load of 6 t for 1 minute using an automatic pelletizer (Type M No. 50 BRP-E from Maekawa Testing Machine Mfg. Co., LTD.) and formed into a pellet having a diameter of 40 mm and a thickness of about 2 mm. The surface of the pellet is subject to a measurement with ATR-FTIR.

As the measuring device, a microscopic FTIR device SPECTRUM ONE (from PerkinElmer Inc.) equipped with an ATR unit is used. The measurement is performed in micro ATR mode using a germanium (Ge) crystal having a diameter of 100 μm. The incidence angle of infrared ray is set to 41.5°, the resolution is set to 4 $cm^{-1}$, and the cumulated number is set to 20.

The intensity ratio of the peak arising from the wax to that arising from the binder resin is defined as the relative amount of the wax existing at the surface of the toner. The measurement is repeated four times changing the measuring position. The measured values are averaged. The absolute amount of the wax existing at the surface of the toner is determined from the relative amount thereof with reference to a calibration curve compiled from several samples in which a known amount of the wax is uniformly dispersed in the binder resin.

The wax existing in the region ranging from the surface to 0.3 μm in depth of the toner can smoothly exude from the toner and effectively exert toner releasability.

Preferably, the amount of the wax existing at the surface of the toner, measured by the ATR-FTIR, ranges from 0.1% to 4.0% by mass. When the amount of the wax existing at the surface of the toner is 0.1% by mass or more, it means that the wax existing near the surface of the toner is not insufficient. Thus, the toner can exert sufficient releasability when being fixed. When the amount of the wax existing at the surface of the toner is 4.0% by mass or less, it means that the wax existing near the surface of the toner is not excessive. Thus, the wax is not exposed at the outermost surface of the toner. The wax will not accelerate adhesion of the toner to carrier particles and will not deteriorate filming resistance of the developer. To achieve a good combination of offset resistance, chargeability, developability, and filming resistance, the amount of the wax existing at the surface of the toner preferably ranges from 0.1 to 3% by mass.

Preferably, the total amount of the wax, measured by the DSC, ranges from 1% to 20% by mass. When the total amount of the wax in the toner is 0.1% by mass or more, it means that the wax contained in the toner is not insufficient. Thus, the toner can exert sufficient releasability when being fixed without degrading offset resistance. When the total amount of the wax in the toner is 20% by mass or less, filming resistance and color image gloss will not deteriorate, which is preferable.

The toner is not limited in terms of compositional material. Examples of the compositional materials of the toner are described below.

Toner Composition

The toner includes at least a binder resin and a release agent, and optionally other components such as a colorant, a colorant dispersant, and a charge controlling agent. The toner may further include a fluidity improver and/or a cleanability improver on its surface, if needed.

Binder Resin

The binder resin is not limited to any particular resin so long as it is soluble in an organic solvent. Specific examples of the binder resin include, but are not limited to, a vinyl polymer or copolymer obtainable from a styrene monomer, an acrylic monomer, and/or a methacrylic monomer, a polyester polymer, polyol resin, phenol resin, silicone resin, polyurethane resin, polyamide resin, furan resin, epoxy resin, xylene resin, terpene resin, coumarone indene resin, polycarbonate resin, and petroleum resin.

Specific examples of the styrene monomer include, but are not limited to, styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, p-nitrostyrene, and derivatives thereof.

Specific examples of the acrylic monomer include, but are not limited to, acrylic acid and acrylic acid ester. Specific examples of the acrylic acid ester include, but are not limited to, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate.

Specific examples of the methacrylic monomer include, but are not limited to, methacrylic acid and methacrylic acid ester. Specific examples of the methacrylic acid ester include, but are not limited to, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethyl aminoethyl methacrylate, and diethyl aminoethyl methacrylate.

The following monomers can also be used for preparing the vinyl polymer or copolymer.

(1) Monoolefins, such as ethylene, propylene, butylene, and isobutylene.
(2) Polyenes, such as butadiene and isoprene.
(3) Vinyl halides, such as vinyl chloride, vinylidene chloride, vinyl bromide, and vinyl fluoride.
(4) Vinyl esters, such as vinyl acetate, vinyl propionate, and vinyl benzoate.
(5) Vinyl ethers, such as vinyl methyl ether, vinyl ethyl ether, and vinyl isobutyl ether.
(6) Vinyl ketones, such as vinyl methyl vinyl ketone, vinyl hexyl ketone, and methyl isopropenyl ketone.
(7) N-Vinyl compounds, such as N-vinyl pyrrole, N-vinyl carbazole, N-vinyl indole, and N-vinyl pyrrolidone.

(8) Vinyl naphthalenes.

(9) Acrylic or methacrylic acid derivatives, such as acrylonitrile, methacrylonitrile, and acrylamide.

(10) Unsaturated dibasic acids, such as maleic acid, citraconic acid, itaconic acid, an alkenyl succinic acid, fumaric acid, and mesaconic acid.

(11) Unsaturated dibasic anhydrides, such as maleic anhydride, citraconic anhydride, itaconic anhydride, an alkenyl succinic anhydride.

(12) Unsaturated dibasic acid monoesters, such as maleic acid monomethyl ester, maleic acid monoethyl ester, maleic acid monobutyl ester, citraconic acid monomethyl ester, citraconic acid monoethyl ester, citraconic acid monobutyl ester, itaconic acid monomethyl ester, alkenyl succinic acid monomethyl ester, fumaric acid monomethyl ester, and mesaconic acid monomethyl ester.

(13) Unsaturated dibasic acid esters, such as dimethyl maleate and dimethyl fumarate.

(14) α,β-Unsaturated acids, such as crotonic acid and cinnamic acid.

(15) α,β-Unsaturated anhydrides, such as crotonic anhydride and cinnamic anhydride.

(16) Monomers having carboxyl group, such as anhydrides of α,β-unsaturated acids with lower fatty acids; and alkenyl malonic acid, alkenyl glutaric acid, alkenyl adipic acid, and anhydrides and monoesters thereof.

(17) Hydroxyalkyl esters of acrylic or methacrylic acids, such as 2-hydroxyethyl acrylate, 2-hydroxyethyl methacrylate, and 2-hydroxypropyl methacrylate.

(18) Monomers having hydroxyl group, such as 4-(1-hydroxy-1-methylbutyl)styrene, 4-(1-hydroxy-1-methylhexyl)styrene.

The vinyl polymer or copolymer may have a cross-linked structure formed by a cross-linker having two or more vinyl groups.

Specific examples of the cross-linker include, but are not limited to: aromatic divinyl compounds, such as divinylbenzene and divinylnaphthalene; diacrylate and dimethacrylate compounds bonded with an alkyl chain, such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, ethylene glycol dimethacrylate, 1,3-butylene glycol dimethacrylate, 1,4-butanediol dimethacrylate, 1,5-pentanediol dimethacrylate, 1,6-hexanediol dimethacrylate, and neopentyl glycol dimethacrylate; and diacrylate and dimethacrylate compounds bonded with an alkyl chain having ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, diethylene glycol dimethacrylate, triethylene glycol dimethacrylate, tetraethylene glycol dimethacrylate, polyethylene glycol #400 dimethacrylate, polyethylene glycol #600 dimethacrylate, and dipropylene glycol dimethacrylate.

Specific examples of the cross-linker further include diacrylate and dimethacrylate compounds bonded with a chain having an aromatic group and ether bond.

Specific examples of the cross-linker further include polyester-type diacrylate compounds such as MANDA (available from Nippon Kayaku Co., Ltd.).

Specific examples of the cross-linker further include polyfunctional cross-linkers, such as pentaerythritol triacrylate, trimethylolethane triacrylate, trimethylolpropane triacrylate, tetramethylolmethane tetraacrylate, oligoester acrylate, pentaerythritol trimethacrylate, trimethylolethane trimethacrylate, trimethylolpropane trimethacrylate, tetramethylolmethane tetramethacrylate, oligoester methacrylate, triallyl cyanurate, and triallyl trimellitate.

Among these cross-linkers, aromatic divinyl compounds (especially divinylbenzene) and diacrylate compounds bonded with a chain having an aromatic group and one ether bond are preferable from the viewpoint of fixability and offset resistance of the binder resin. In particular, combinations of monomers which produce a styrene copolymer or styrene-acrylic copolymer are preferable.

Specific examples of polymerization initiators used for the preparation of the vinyl polymer or copolymer include, but are not limited to: ketone peroxides, such as 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis-(1-cyclohexanecarbonitrile), 2-(carbamoylazo)-isobutyronitrile, 2,2'-azobis(2,4,4-trimethylpentane), 2-phenylazo-2',4'-dimethyl-4'-methoxyvaleronitrile, 2,2'-azobis(2-methylpropane), methyl ethyl ketone peroxide, acetylacetone peroxide, and cyclohexanone peroxide; and 2,2-bis(tert-butylperoxy)butane, tert-butyl hydroperoxide, cumene hydroperoxide, 1,1,3,3-tetramethylbutylhydroperoxide, di-tert-butyl peroxide, tert-butylcumyl peroxide, dicumyl peroxide, α-(tert-butylperoxy)isopropylbenzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropyl peroxydicarbonate, di-2-ethylhexyl peroxydicarbonate, di-n-propyl peroxydicarbonate, di-2-ethoxyethyl peroxycarbonate, di-ethoxyisopropyl peroxydicarbonate, di(3-methyl-3-methoxybutyl)peroxycarbonate, acetylcyclohexylsulfonyl peroxide, tert-butyl peroxyacetate, tert-butyl peroxyisobutyrate, tert-butyl peroxy-2-ethylhexanoate, tert-butyl peroxylaurate, tert-butyl oxybenzoate, tert-butyl peroxyisopropylcarbonate, di-tert-butyl peroxyisophthalate, tert-butyl peroxyallylcarbonate, isoamylperoxy-2-ethylhexanoate, di-tert-butyl peroxyhexahydroterephthalate, and tert-butyl peroxyazelate.

When the binder resin is a styrene-acrylic resin, a molecular weight distribution of tetrahydrofuran (THF) solubles in the resin which is measured by gel permeation chromatography (GPC) has at least one peak at a number average molecular weight of from 3,000 to 50,000.

Specific examples of monomers for preparing the polyester polymer include, but are not limited to, divalent alcohols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and a diol obtained from a polymerization between bisphenol A and a cyclic ether (e.g., ethylene oxide, propylene oxide).

By using a polyol having 3 or more valences or an acid having 3 or more valences in combination, the resulting polyester resin can have a cross-linked structure. The used amount of such a polyol or an acid should be controlled such that the resulting resin is not prevented from being dissolved in an organic solvent.

Specific examples of the polyol having 3 or more valences include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Specific examples of acid components for producing the polyester polymer include, but are not limited to, benzene dicarboxylic acids (e.g., phthalic acid, isophthalic acid, terephthalic acid) and anhydrides thereof, alkyl dicarboxylic acids (e.g., succinic acid, adipic acid, sebacic acid, azelaic acid) and anhydrides thereof, unsaturated dibasic acids (e.g., maleic acid, citraconic acid, itaconic acid, alkenyl succinic acid, fumaric acid, mesaconic acid), and unsaturated dibasic acid anhydrides (e.g., maleic acid anhydride, citraconic acid anhydride, itaconic acid anhydride, alkenyl succinic acid anhydride).

Specific examples of polycarboxylic acid components having 3 or more valences include, but are not limited to, trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxy)methane, 1,2,7,8-octanetetracarboxylic acid, enpol trimmer acid, and anhydrides and partial lower alkyl esters of these compounds.

When the binder resin is a polyester resin, a molecular weight distribution of THF solubles in the resin which is measured by gel permeation chromatography (GPC) has at least one peak at a number average molecular weight of from 3,000 to 50,000 from the viewpoint of fixability and offset resistance of the toner. Preferably, the content ratio of THF solubles having a molecular weight of 100,000 or less in the binder resin is from 70% to 100% from the viewpoint of discharge performance. More preferably, the molecular weight distribution of the binder resin has at least one peak at a molecular weight of from 5,000 to 20,000.

In the present disclosure, the molecular weight distribution of the binder resin is measured by gel permeation chromatography (GPC) using THF as a solvent.

When the binder resin is a polyester resin, the polyester resin preferably has an acid value of from 0.1 to 100 mgKOH/g, more preferably from 0.1 to 70 mgKOH/g, and most preferably from 0.1 to 50 mgKOH/g.

In the present disclosure, the acid value of the binder resin component in the toner composition is measured based on the following method according to JIS K-0070.

(1) A measurement sample is prepared by previously removing components other than the binder resin (polymer) component from the toner composition, or previously measuring the acid values and contents of the components other than the binder resin (polymer) content in the toner composition. The measurement sample, having been pulverized, in an amount of from 0.5 to 2.0 g is precisely weighed. This weight is identified as the polymer component weight W (g). For example, to measure the acid value of the binder resin in the toner, the acid values and contents of a colorant, a magnetic material, etc., should be previously measured so that the acid value of the binder resin can be calculated.

(2) The measurement sample is dissolved in 150 ml of a mixed liquid of toluene/ethanol (volume ratio: 4/1) in a 300-ml beaker.

(3) The resulting solution is subjected to a titration with a 0.1 mol/l ethanol solution of KOH using a potentiometric titrator.

(4) The consumed amount of the KOH solution in the titration is identified as S (ml). The consumed amount of the KOH solution in a blank titration is identified as B (ml). The acid value can be calculated from the following formula (C). In the formula (C), f represents the factor of KOH.

$$\text{Acid Value (mgKOH/g)}=[(S-B)\times f\times 5.61]/W \quad \text{(C)}$$

Both the binder resin and the toner composition containing the binder resin preferably have a glass transition temperature (Tg) of from 35° C. to 80° C., more preferably from 40° C. to 70° C.

When Tg is less than 35° C., the toner may deteriorate in a high-temperature atmosphere. When Tg is greater than 80° C., the fixability of the toner may deteriorate.

The type of the binder resin can be properly selected depending on the types of organic solvent and release agent to be used in combination. When a release agent which is well soluble in an organic solvent is used, the softening point of the toner may be reduced. In such a case, the weight average molecular weight of the binder resin should be increased to increase the softening point of the binder resin and enhance hot offset resistance of the toner.

Colorant

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

The content of the colorant in the toner is preferably from 1% to 15% by mass and more preferably from 3% to 10% by mass.

The colorant can be combined with a resin to be used as a master batch.

Specific examples of the resin for use in the master batch include, but are not limited to, modified or unmodified polyester resin, polymers of styrene and derivatives thereof (e.g., polystyrene, poly-p-chlorostyrene, polyvinyl toluene), styrene copolymers (e.g., styrene-p-chlorostyrene copolymer, styrene-propylene copolymer, styrene-vinyl toluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

The master batch can be obtained by mixing and kneading a resin and a colorant while applying a high shearing force.

To increase the interaction between the colorant and the resin, an organic solvent can be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried.

When performing the mixing and kneading, a high shearing force dispersing device such as a three roll mill can be preferably used.

The used amount of the master batch is preferably from 0.1 to 20 parts by mass based on 100 parts by mass of the binder resin.

The resin for the master batch preferably has an acid value of 30 mgKOH/g or less and an amine value of from 1 to 100. More preferably, the acid value is from 20 mgKOH/g or less and the amine value is from 10 to 50.

When the acid value exceeds 30 mgKOH/g or less, chargeability may deteriorate under high-humidity conditions and colorant dispersibility may become insufficient. When the amine value is less than 1 or greater than 100, colorant dispersibility may become insufficient.

The acid value can be measured based on a method according to JIS K-0070. The amine value can be measured based on a method according to JIS K-7237.

Colorant Dispersant

The colorant can be dispersed in a colorant dispersion liquid with a colorant dispersant.

Any known colorant dispersant can be used. Dispersants having high affinity for the binder resin are preferable from the viewpoint of colorant dispersibility. Specific examples of such dispersants include, but are not limited to, commercially available dispersants such as AJISPER PB821 and PB822 (from Ajinomoto Fine-Techno Co., Inc.), DISPERBYK-2001 (from BYK-Chemie GmbH), and EFKA-4010 (from EFKA).

The colorant dispersant preferably has a weight average molecular weight of from 500 to 100,000, which is a styrene-converted local maximum molecular weight of the main peak in a molecular weight distribution chart obtained by gel permeation chromatography. From the viewpoint of colorant dispersibility, the molecular weight ranges more preferably from 3,000 to 100,000, much more preferably from 5,000 to 50,000, and most preferably from 5,000 to 30,000. When the molecular weight is less than 500, the polarity becomes so high that the colorant dispersibility may deteriorate. When the molecular weight is in excess of 100,000, the affinity for the solvent becomes so high that the colorant dispersibility may deteriorate.

The addition amount of the colorant dispersant is preferably from 1 to 200 parts by mass, more preferably from 5 to 80 parts by mass, based on 100 parts by mass of the colorant. When the addition amount is less than 1 part by mass, colorant dispersibility may deteriorate. When the addition amount is in excess of 200 parts by mass, chargeability may deteriorate.

Release Agent

Specific examples of the release agent include, but are not limited to, aliphatic hydrocarbon waxes (e.g., low-molecular-weight polyethylene, low-molecular-weight polypropylene, polyolefin wax, microcrystalline wax, paraffin wax, SASOL wax), oxides of aliphatic hydrocarbon waxes (e.g., oxidized polyethylene wax) and block copolymers thereof, plant waxes (e.g., candelilla wax, carnauba wax, sumac wax, jojoba wax), animal waxes (e.g., bees wax, lanolin, spermaceti), mineral waxes (e.g., ozokerite, ceresin, petrolatum), waxes mainly composed of fatty acid esters (e.g., montanate wax, castor wax), synthetic ester waxes, and synthetic amide waxes.

Specific examples of the release agents further include, but are not limited to, saturated straight-chain fatty acids (e.g., palmitic acid, stearic acid, montanic acid, straight-chain alkylcarboxylic acids), unsaturated fatty acids (e.g., brassidic acid, eleostearic acid, parinaric acid), saturated alcohols (e.g., stearyl alcohol, eicosyl alcohol, behenyl alcohol, carnaubyl alcohol, ceryl alcohol, melissyl alcohol, long-chain alkyl alcohol), polyols (e.g., sorbitol), fatty acid amides (e.g., linoleic acid amide, olefin acid amide, lauric acid amide), saturated fatty acid bisamides (e.g., methylenebis capric acid amide, ethylenebis lauric acid amide, hexamethylenebis stearic acid amide), unsaturated fatty acid amides (e.g., ethylenebis oleic acid amide, hexamethylenebis oleic acid amide, N,N'-dioleyl adipic acid amide, N,N'-dioleyl sebacic acid amide), aromatic bisamides (e.g., m-xylenebis stearic acid amide, N,N-distearyl isophthalic acid amide), metal salts of fatty acids (e.g., calcium stearate, calcium laurate, zinc stearate, magnesium stearate), aliphatic hydrocarbon waxes to which a vinyl monomer such as styrene and an acrylic acid is grafted, partial ester compounds of a fatty acid with a polyol (e.g., behenic acid monoglyceride), and methyl ester compounds having a hydroxyl group obtained by hydrogenating plant fats.

The above release agents which have been further subjected to a press sweating method, a solvent method, a recrystallization method, a vacuum distillation method, a supercritical gas extraction method, or a solution crystallization method, so as to more narrow the molecular weight distribution thereof, are also usable. Further, the above release agents from which impurities, such as low-molecular-weight solid fatty acids, low-molecular-weight solid alcohols, and low-molecular-weight solid compounds, have been removed are also usable.

The release agent preferably has a melting point of 65° C. or more, more preferably from 69° C. to 120° C., to balance fixability and offset resistance.

When the melting point is 65° C. or more, the blocking resistance may not deteriorate. When the melting point is 120° C. or less, sufficient offset resistance is provided.

The melting point of the release agent is defined as a temperature at which the maximum endothermic peak is observed in an endothermic curve of the release agent measured by differential scanning calorimetry (DSC).

Preferably, the melting point of the release agent or toner is measured with a high-precision inner-heat power-compensation differential scanning calorimeter based on a method according to ASTM D3418-82. The endothermic curve is obtained by preliminarily heating and cooling a sample and then heating the sample at a heating rate of 10° C./min.

The content of the release agent is determined depending on the melt viscoelasticity of the binder resin and/or the fixing method, and is preferably from 1 to 50 parts by mass based on 100 parts by mass of the binder resin.

Charge Controlling Agent

Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Specific examples of usable commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LRA-901, and LR-147 (boron complex), which are manufactured by Japan Carlit Co., Ltd.; and copper phthalocyanine, perylene, quinacridone, azo pigments, and polymers having a functional group such as a sulfonate group, a carboxyl group, and a quaternary ammonium group, phenol resins, and fluorine-based compounds.

The used amount of the charge controlling agent is determined depending on the type of the binder resin, existence or non-existence of an additive, the toner production method including its dispersion method, etc., and is not limited to a particular value. The used amount of the charge controlling agent is preferably from 0.1 to 10 parts by mass, more preferably from 0.2 to 5 parts by mass, based on 100 parts by mass of the binder resin. When the used amount of the charge controlling agent is in excess of 10 parts by mass, the toner fixability may be inhibited.

From the viewpoint of production stability, the charge controlling agent is preferably used in a state being dissolved in an organic solvent. Alternatively, the charge controlling agent can be used in a state being finely dispersed in an organic solvent by a bead mill.

Toner

The toner preferably has a volume average particle diameter of from 1 to 8 μm so as to form high-resolution high-definition high-quality image.

The particle size distribution (i.e., the ratio of the volume average particle diameter to the number average particle diameter) of the toner is preferably from 1.00 to 1.15 so as to produce reliable image for an extended period of time.

In particular, the toner preferably has a volume-based particle size distribution having a second peak particle diameter being from 1.21 to 1.31 times the model diameter. When the second peak particle diameter does not exist, and especially when the ratio of the volume average particle diameter to the number average particle diameter is near 1.00 (i.e., monodisperse), it means that the toner is very likely to take a closely-packing structure, which causes degradation in initial fluidity and cleanability. When a peak particle diameter which is greater than 1.31 times the model diameter exists, it means that the toner includes a large amount of coarse particles that degrade image granularity.

The toner may further include a fluidity improver and/or a cleanability improver on its surface, if needed.

Fluidity Improver

The toner may include a fluidity improver. The fluidity improver improves fluidity of the toner by existing at the surface of the toner.

Specific examples of the fluidity improver include, but are not limited to, a fine powder of silica prepared by a wet process or a dry process; fine powders of metal oxides such as titanium oxide and alumina; and fine powders of silica, titanium oxide, and alumina which are surface-treated with a silane-coupling agent, a titanium-coupling agent, or a silicone oil; and fine powders of fluorocarbon resins such as vinylidene fluoride and polytetrafluoroethylene. Among these materials, fine powders of silica, titanium oxide, and alumina are preferable. In addition, a fine powder of silica which is surface-treated with a silane-coupling agent or a silicone oil is preferable.

The fluidity improver preferably has an average primary particle diameter of from 0.001 to 2 μm and more preferably from 0.002 to 0.2 μm.

The fine powder of silica can be obtained by gas phase oxidation of a silicon halide, and is generally called as dry-method silica or fumed silica.

Specific examples of commercially available fine powder of silica obtained by gas phase oxidation of a silicon halide include, but are not limited to, AEROSIL-130, -300, -380, -TT600, -MOX 170, -MOX80, and -COK84 (from Nippon Aerosil Co., Ltd.); CAB-O-SIL-M-5, -MS-7, -MS-75, -HS-5, and -EH-5 (from Cabot Corporation); WACKER HDK-N20V15, -N20E, -T30, and -T40 (from Wacker Chemie AG); D-C Fine Silica (from Dow Corning Corporation); and Fransol (from Fransil).

In addition, a fine powder of hydrophobized silica, obtained by hydrophobizing the fine powder of silica obtained by gas phase oxidation of a silicon halide, is also preferable. The hydrophobized silica preferably has a hydrophobicity degree of from 30% to 80% measured by a methanol titration test. Hydrophobicity is given by chemically or physically treating a fine powder of silica with a material which is reactive with or adsorptive to the silica, such as an organic silicon compound. Treating the fine powder of silica obtained by gas phase oxidation of a silicon halide with an organic silicon compound is preferable.

Specific examples of the organic silicon compound include, but are not limited to, hydroxypropyltrimethoxysilane, phenyltrimethoxysilane, n-hexadecyltrimethoxysilane, n-octadecyltrimethoxysilane, vinylmethoxysilane, vinyltriethoxysilane, vinyltriacetoxysilane, dimethylvinylchlorosilane, divinylchlorosilane, γ-methacryloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinylmethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and 0 or 1 hydroxyl group bonded to Si in each terminal unit. Other than the above compounds, silicone oils such as dimethyl silicone oil are also usable. Two or more of these compounds can be used in combination.

The fluidity improver preferably has a number average particle diameter of from 5 to 100 nm and more preferably from 5 to 50 nm.

The fluidity improver preferably has a specific surface area of from 30 $m^2/g$ or more, more preferably from 60 to 400 $m^2/g$, measured by the BET method employing nitrogen adsorption.

When the fluidity improver is a surface-treated powder, the fluidity improver preferably has a specific surface area of 20 $m^2/g$ or more, more preferably from 40 to 300 $m^2/g$, measured by the BET method employing nitrogen adsorption.

The used amount of the fluidity improver is preferably from 0.03 to 8 parts by mass based on 100 parts by mass of the toner.

Cleanability Improver

The cleanability improver improves removability of residual toner particles remaining on an electrostatic latent image bearer or primary transfer medium after a toner image has been transferred therefrom onto a recording medium. Specific examples of the cleanability improver include, but are not limited to, metal salts of fatty acids (e.g., zinc stearate, calcium stearate) and fine particles of polymers prepared by soap-free emulsion polymerization (e.g., polymethyl methacrylate, polystyrene). Preferably, the fine particles of polymers have a relatively narrow size distribution and a volume average particle diameter of from 0.01 to 1 μm.

The fluidity improver and cleanability improver are adhered to or fixed on the surface of the toner. Therefore, they are collectively called as external additives. The external additives can be added to the toner by, for example, a powder mixer. Specific examples of the powder mixer include, but are not limited to, V-type mixer, Rocking mixer, Loedige mixer, Nauta mixer, and Henschel mixer. Specific examples of the powder mixer which has a function of fixing the external additives to the toner include, but are not limited to, HYBRIDIZER, MECHANOFUSION®, and Q-TYPE MIXER.

Developer

The toner can be mixed with a carrier to be used as the two-component developer.

Carrier

Specific examples of the carrier include, but are not limited to, a ferrite carrier, a magnetite carrier, and a resin-coated carrier. The resin-coated carrier is composed of a core particle and a covering material that is a resin covering the core particle. Specific examples of the covering material include, but are not limited to, a styrene-acrylic resin (e.g., styrene-acrylate copolymer, styrene-methacrylate copolymer), an acrylic resin (e.g., acrylate copolymer, methacrylate copolymer), a fluorine-containing resin (e.g., polytetrafluoroethylene, monochlorotrifluoroethylene polymer, polyvinylidene fluoride), a silicone resin, a polyester resin, a polyamide resin, a polyvinyl butyral resin, and an aminoacrylate resin. In addition, an ionomer resin and a polyphenylene sulfide resin are also usable. Two or more of these resins can be used in combination.

Specific examples of the carrier further include a binder-type carrier in which a magnetic powder is dispersed in a resin. With respect to the resin-coated carrier, the surface of the core particle is covered with the resin (covering material) by a method such that the resin is dissolved or suspended in a solvent and then the solution or suspension is applied to the core particle, or the resin and the core particle are merely mixed in a powder state. The content ratio of the covering material is preferably from 0.01% to 5% by mass, more preferably from 0.1% to 1% by mass, based on 100 parts by mass of the resin-coated carrier.

Specific examples the carrier in which a magnetic material is covered with a mixture of two or more kinds of covering materials include, but are not limited to, the following.

(1) A titanium oxide powder in an amount of 100 parts by mass treated with a mixture of methyldichlorosilane and dimethyl silicone oil (at a mass ratio of 1:5) in an amount of 12 parts by mass.

(2) A silica powder in an amount of 100 parts by mass treated with a mixture of dimethyldichlorosilane and dimethyl silicone oil (at a mass ratio of 1:5) in an amount of 20 parts by mass.

Specific examples of the covering material further include, but are not limited to, a styrene-methyl methacrylate copolymer, a mixture of a fluorine-containing resin and a styrene copolymer, and a silicone resin. Among these resins, a silicone resin is preferable.

Specific examples of the mixture of a fluorine-containing resin and a styrene copolymer include, but are not limited to, a mixture of a polyvinylidene fluoride and a styrene-methyl methacrylate copolymer; a mixture of polytetrafluoroethylene and a styrene-methyl methacrylate copolymer; and a mixture of a vinylidene fluoride-tetrafluoroethylene copolymer (at a copolymerization mass ratio of from 10:90 to 90:10), a styrene-2-ethylhexyl acrylate copolymer (at a copolymerization mass ratio of from 10:90 to 90:10), and a styrene-2-ethylhexyl acrylate-methyl methacrylate copolymer (at a copolymerization mass ratio of from 20:60:5 to 30:10:50). Specific examples of the silicone resin include, but are not limited to, a nitrogen-containing silicon resin and a modified silicone resin obtained by reacting a nitrogen-containing silane-coupling agent with a silicone resin.

Specific magnetic materials usable as the core particle include, but are not limited to, an oxide (e.g., ferrite, iron-excess ferrite, magnetite, γ-iron oxide), a metal (e.g., iron, cobalt, nickel), and an alloy thereof. These magnetic materials may include an element such as iron, cobalt, nickel, aluminum, copper, lead, magnesium, tin, zinc, antimony, beryllium, bismuth, calcium, manganese, selenium, titanium, tungsten, and vanadium. Among these magnetic materials, a copper-zinc-iron ferrite composed primarily of copper, zinc, and iron, and a manganese-magnesium-iron ferrite composed primarily of manganese, magnesium, and iron are preferable.

Depending on the surface roughness of the carrier and the content of the covering material, the carrier preferably has a volume resistivity of from $10^6$ to $10^{10}$ Ω·cm. The carrier preferably has a particle diameter of from 4 to 200 μm, more preferably from 10 to 150 μm, and most preferably from 20 to 100 μm. In particular, the resin-coated carrier preferably has a 50% particle diameter of from 20 to 70 μm. The two-component developer preferably contains the toner in an amount of from 1 to 200 parts by mass, more preferably from 2 to 50 parts by mass, per 100 parts by mass of the carrier.

In a developing method using the toner according to an embodiment of the present invention, any electrophotographic electrostatic latent image bearer can be used. For example, an organic electrostatic latent image bearer, an amorphous silica electrostatic latent image bearer, a selenium electrostatic latent image bearer, and a zinc oxide electrostatic latent image bearer are preferable.

Method of Manufacturing Toner

One example of the method of manufacturing the toner is described below.

The toner according to an embodiment of the present invention can be obtained through the processes of: forming liquid droplets by discharging a toner composition liquid in which the binder resin and the release agent are dissolved or dispersed in a solvent; and solidifying the liquid droplets to form fine particles.

Specific examples of the release agent include, but are not limited to, a wax. Here, the wax is required to be soluble in the toner composition liquid. Hence, a wax which is soluble in the solvent of the toner composition liquid should be used.

It is possible that the release agent is dissolved in the solvent or the toner composition liquid by application of heat. To achieve stable continuous discharge, the temperature of the toner composition liquid is preferably less than (Tb-20)° C., where Tb represents the boiling point of the solvent, under the environmental temperature during the process of solidifying the liquid droplets.

When the temperature of the solvent is less than (Tb-20)° C., generation of bubbles due to vaporization of the solvent in a toner composition liquid chamber or narrowing of discharge holes due to drying-out of the toner composition liquid near the discharge holes are prevented and stable discharge can be achieved.

To prevent the release agent from clogging the discharge holes, the release agent is preferably dissolved in the toner composition liquid. At the same time, the release agent is preferably dissolved in the binder resin being dissolved in the toner composition liquid without causing phase separation, to obtain uniform toner particles. It is also preferable that the binder resin and the release agent are phase-separated in the resultant toner particles from which the solvent has been removed, so that the toner can exert releasability when being fixed to prevent the occurrence of the offset phenomenon. In case that the release agent and the binder resin are not phase-separated in the toner particles, the toner cannot exert releasability. Moreover, the melt viscosity and elasticity of the binder resin are so decreased that the hot offset phenomenon is likely to occur.

Accordingly, the release agent should be selected depending on the type of the solvent and binder resin in use.

The toner composition liquid can be obtained by dissolving or dispersing the toner composition in an organic solvent. The toner composition includes at least the binder resin and the release agent and optionally other components such as a colorant, a colorant disperser, and a charge control agent, if needed. The organic solvent is not limited to any particular material so long as it is volatile and capable of dissolving or dispersing the toner composition without causing phase separation of the binder resin and the release agent. Specific preferred examples of the organic solvent include, but are not limited to, an ether, a ketone, a hydrocarbon, and an alcohol. In particular, tetrahydrofuran (THF), acetone, methyl ethyl ketone (MEK), ethyl acetate, toluene, and water are more preferable. Each of these solvents can be used alone or in combination with others.

Method of Preparing Toner Composition Liquid

The toner composition liquid can be prepared by dissolving or dispersing the toner composition in the organic solvent. The toner composition is dissolved or dispersed in the solvent by means of a homomixer or a bead mill so that the dispersoids (e.g., a colorant) become finer than the opening diameter of the discharge holes and discharge hole clogging is prevented. Preferably, the toner composition liquid has a solid content concentration of from 3% to 40% by mass. When the solid content concentration is less than 3% by mass, it is likely that the productivity decreases and the dispersoids (i.e., colorant, release agent particles) settle out or aggregate. As a result, the composition of the toner particles may become nonuniform and the toner quality may degrade. When the solid content concentration exceeds 40% by mass, toner particles having a small particle diameter may not be obtained. The toner composition liquid can be formed into liquid droplets by discharging the toner composition liquid by a liquid droplet discharge device. Preferably, the toner composition liquid has a liquid temperature of from 50° C. to 60° C. When the liquid temperature is less than 50° C., liquid droplets cannot be dried immediately after the discharge, causing coalescence and deterioration in particle size distribution. When the liquid temperature is in excess of 60° C., the solvent more easily evaporates to increase the solid content concentration. It is difficult to obtain a toner having a desired particle size.

Liquid Droplet Discharge Device

The liquid droplet discharge device is not limited to any particular device so long as the particle diameter distribution of the discharged liquid droplets becomes narrow. The liquid droplet discharge device is of several types: a single-fluid nozzle, a two-fluid nozzle, a film vibration discharge device (described in Japanese Patent No. 5055154), a Rayleigh fission discharge device (described in Japanese Patent No. 4647506), a liquid vibration discharge device (described in Japanese Patent No. 5315920), and a liquid column resonance discharge device (described in Japanese Unexamined Patent Application Publication No. 2011-212668). To produce liquid droplets having a narrow particle size distribution while securing toner productivity, a liquid column resonance discharge device is preferable. In the liquid column resonance discharge device, a vibration is applied to a liquid contained in a liquid column resonance liquid chamber having multiple discharge holes to form a liquid column resonant standing wave therein, and the liquid is discharged from the multiple discharge holes which are formed within area corresponding to antinodes of the liquid column resonant standing wave.

Liquid Column Resonance Liquid Droplet Discharge Device

Figure 8:
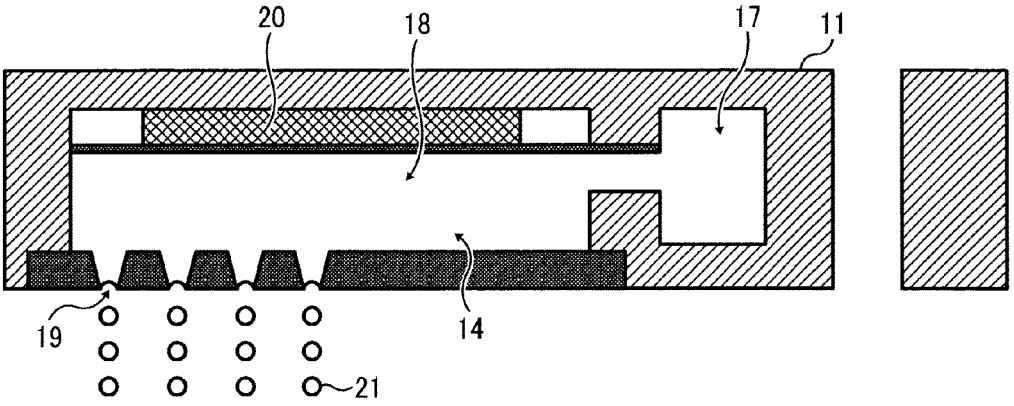
FIG. 8 is a cross-sectional view of a liquid droplet discharge device for manufacturing a toner according to an embodiment of the present invention.

One example of the liquid column resonance liquid droplet discharge device is described in detail below. FIG. 8 is a schematic view of a liquid column resonance liquid droplet discharge device 11. The liquid column resonance liquid droplet discharge device 11 has a liquid common supply path 17 and a liquid column resonance liquid chamber 18. The liquid column resonance liquid chamber 18 is communicated with the liquid common supply path 17 disposed on its one end wall surface in a longitudinal direction. The liquid column resonance liquid chamber 18 has discharge holes 19 to discharge liquid droplets 21, on its one wall surface which is connected with its both longitudinal end wall surfaces. The liquid column resonance liquid chamber 18 also has a vibration generator 20 to generate high-frequency vibration for forming a liquid column resonant standing wave, on the wall surface facing the discharge holes 19. The vibration generator 20 is connected to a high-frequency power source. The liquid to be discharged from the liquid droplet discharge device is a toner composition liquid in which the toner composition is dissolved or dispersed. A toner composition liquid 14 is flowed into the liquid common supply path 17 through a liquid supply tube by a liquid circulating pump and is supplied to the liquid column resonance liquid chamber 18. Within the liquid column resonance liquid chamber 18 filled with the toner composition liquid 14, the vibration generator 20 causes liquid column resonance and generates a pressure standing wave. Thus, a pressure distribution is formed therein. The liquid droplets 21 are discharged from the discharge holes 19 provided within an area corresponding to an antinode of the pressure standing wave, where the amplitude in pressure variation is large. The area corresponding to an antinode is defined as an area not corresponding to a node of the pressure standing wave. Preferably, the area corresponding to an antinode is an area where the amplitude in pressure variation of the standing wave is large enough to discharge liquid droplets. More preferably, the area corresponding to an antinode is an area extending from a position at a local maximum amplitude (i.e., a node of the velocity standing wave) toward a position at a local minimum amplitude for a distance ±¼ of the wavelength of the pressure standing wave. Within the area corresponding to an antinode of the pressure standing wave, even in a case in which multiple discharge holes are provided, each of the multiple discharge holes discharges uniform liquid droplets at a high degree of efficiency without causing clogging. After passing the liquid common supply path 17, the toner composition liquid 14 flows into a liquid return pipe and returns to a raw material container. As the liquid droplets 21 are discharged, the amount of the toner composition liquid 14 in the liquid column resonance liquid chamber 18 is reduced and a suction force generated by the action of the liquid column resonance standing wave is also reduced within the liquid column resonance liquid chamber 18. Thus, the liquid common supply path 17 temporarily increases the flow rate of the toner composition liquid 14 to fill the liquid column resonance liquid chamber 18 with the toner composition liquid 14. After the liquid column resonance liquid chamber 18 is refilled with the toner composition liquid 14, the flow rate of the toner composition liquid 14 in the liquid common supply path 17 is returned.

Liquid Droplet Conveyance-Solidification Device

The method for solidifying the liquid droplets is selected depending on the nature of the toner composition liquid, and is not limited to a specific method so long as the toner composition liquid can be solidified.

For example, when the toner composition liquid is comprised of a volatile solvent in which solid raw materials are dissolved or dispersed, the discharged liquid droplets can be solidified by drying the liquid droplets, in other words, evaporating the solvent, in a carrier gas flow. The drying condition is controllable by controlling the temperature of the injection gas, vapor pressure, and kind of the gas. The liquid droplets need not necessarily be completely dried so long as the collected particles are kept in a solid state. In this case, the collected particles may be subject to an additional drying process. Alternatively, the drying can be achieved by means of temperature change, chemical reaction, etc.

When the liquid droplets are solidified, the release agent is recrystallized. Preferably, the release agent is grown so that the longest length Lmax of the release agent domain becomes equal to or greater than 1.1 times the maximum Feret diameter Df of the toner particle in which the release agent domain is contained. To achieve this, a first approach involves drying the liquid droplets under an atmosphere having a temperature of (Tc-5)° C. or more, where Tc represents the recrystallization temperature of the release agent. A second approach involves drying the liquid droplets in an environment where the relative humidity of the solvent in the toner composition liquid is adjusted to from 10% to 40%, even when the atmosphere has a temperature of (Tc-5)° C. or less. In either approach, the growth of the crystal domains can be accelerated by slowing the recrystallization rate of the release agent and/or the solvent drying rate.

Solidified Particle Collector

The solidified particles can be collected by any powder collector, such as a cyclone collector or a back filter.

Figure 9:
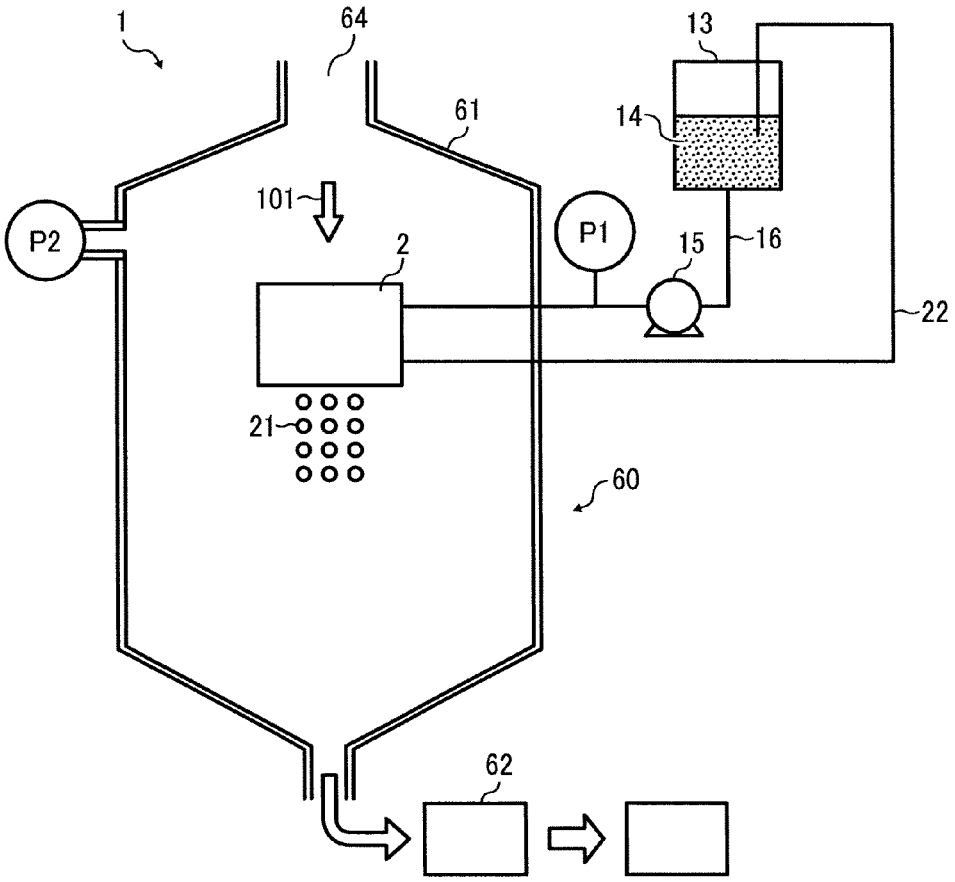
FIG. 9 is a schematic view of a toner manufacturing apparatus for manufacturing a toner according to an embodiment of the present invention.

FIG. 9 is a cross-sectional view of an apparatus for manufacturing the toner according to an embodiment of the present invention. A toner manufacturing apparatus 1 has a liquid droplet discharge unit 2 and a drying collecting unit 60. The liquid droplet discharge unit 2 is connected to a raw material container 13 to contain the toner composition liquid 14 through a liquid supply pipe 16 to supply the toner composition liquid 14 from the raw material container 13 to the liquid droplet discharge unit 2. The liquid droplet discharge device 2 is further connected to a liquid return pipe 22 to return the toner composition liquid 14 to the raw material container 13, and a liquid circulating pump 15 to pump the toner composition liquid 14 within the liquid supply pipe 16. Thus, the toner composition liquid 14 can be constantly supplied to the liquid droplet discharge unit 2. The liquid supply pipe 16 and the drying collecting unit 60 are equipped with pressure gauges P1 and P2, respectively. The pressure gauges P1 and P2 monitor the liquid feed pressure toward the liquid droplet discharge device 2 and the inner pressure of the drying collecting unit 60, respectively. When the pressure measured by the pressure gauge P1 is greater than that measured by the pressure gauge P2 (i.e., P1>P2), there is a concern that the toner composition liquid 14 leaks from the discharge holes. When the pressure measured by the pressure gauge P1 is smaller than that measured by the pressure gauge P2 (i.e., P1<P2), there is a concern that a gas flows in the liquid droplet discharge device 2 and the liquid droplet discharge phenomenon is stopped. Thus, preferably, the pressure measured by the pressure gauge P1 is nearly identical to that measured by the pressure gauge P2. Within a chamber 61, a descending conveyance airflow 101 is formed through a conveyance air current inlet 64. Liquid droplets 21 discharged from the liquid droplet discharge device 2 are conveyed downward by the action of gravity as well as the conveyance airflow 101 and collected by a solidified particle collector 62.

Conveyance Airflow

If the injected liquid droplets are brought into contact with each other before being dried, the liquid droplets coalesce with each other to form a single particle. (This phenomenon is hereinafter referred to as "coalescence".) To obtain solidified particles having a uniform particle diameter distribution, it is preferable that the distance between the injected liquid droplets is kept constant. Although the initial velocity is constant, the injected liquid droplet is gradually stalled due to air resistance. As a result, a posterior liquid droplet may catch up on and coalesce with the stalled particle. Because this phenomenon occurs constantly, the particle diameter distribution of the resulting collected particles may become undesirably wide. To prevent coalescence of liquid droplets, liquid droplets should be conveyed to the solidified particle collector 62 by the conveyance airflow 101 while being solidified without being stalled or brought into contact with each other.

The conveyance airflow 101 is not limited in condition, and may be, for example, a laminar flow, a swirl flow, or a turbulent flow. The conveyance airflow 101 is not limited in substance, and may be formed of, for example, the air or a noncombustible gas such as nitrogen. The temperature of the conveyance airflow 101 is variable but is preferably constant during the manufacturing operation. The chamber 61 may further include a unit for changing the condition of the conveyance airflow 101. The conveyance airflow 101 may prevent not only the coalescence of the liquid droplets 21 but also the adhesion of the liquid droplets 21 to the chamber 61.

Secondary Drying

When toner particles collected in the drying collecting unit 60 illustrated in FIG. 9 contain a large amount of residual solvent, the toner particles can be optionally subjected to a secondary drying to reduce the amount residual solvent. The secondary drying can be performed by any drier, such as a fluidized-bed drier or a vacuum drier. If residual solvent is remaining in the toner particles, toner properties such as heat-resistant storage stability, fixability, and chargeability may deteriorate with time. Moreover, when such toner particles are fixed on a recording material by application of heat, the solvent volatilizes with increasing a possibility of adversely affecting users and peripheral devices.

The cleaning blade according to an embodiment of the present invention is described in detail below.

Figure 5A:
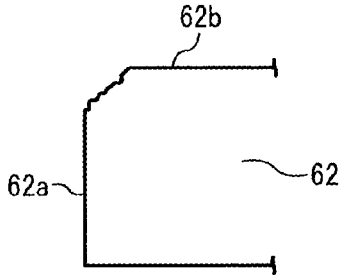
FIG. 5A RELATED ART
FIG. 5A is an illustration of a related-art cleaning blade, the end surface of which has been locally worn.
Figure 5B:
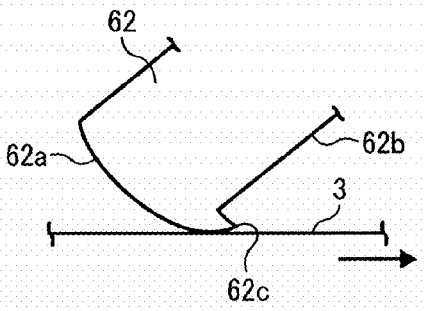
FIG. 5B RELATED ART
FIG. 5B is an illustration of a related-art cleaning blade, the tip ridgeline part of which has turned up.
Figure 5C:
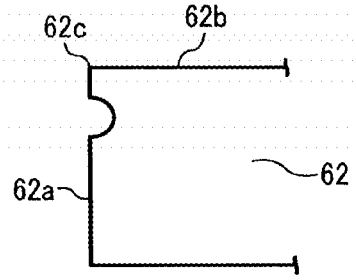
FIG. 5C RELATED ART
FIG. 5C is an illustration of a related-art cleaning blade, the tip ridgeline part of which has been chipped.

The above-described toner according to an embodiment of the present invention cannot be completely removed from the surface of the photoconductor 3 in the same way as a conventional pulverized toner is removed therefrom by the cleaning blade 62, thus causing defective cleaning of the photoconductor 3. There has been an attempt to increase the contact pressure of the cleaning blade 62 with the photoconductor 3 to improve cleanability of toner. However, this attempt causes wear of the cleaning blade 62, as is illustrated in FIG. 5A, much earlier. In this attempt, the frictional force between the cleaning blade 62 and the photoconductor 3 is also increased. As a result, it is likely that a tip ridgeline of the cleaning blade 62 which is in contact with the photoconductor 3 is pulled in the direction of movement of the photoconductor 3. As a result, the tip ridgeline of the cleaning blade 62 turns up, as illustrated in FIG. 5B. Turning up of the tip ridgeline of the cleaning blade 62 may cause various problems such as abnormal noise, abnormal vibration, and/or chipping of the tip ridgeline, as is illustrated in FIG. 5C.

In view of this situation, the cleaning blade according to an embodiment of the present invention has the following configuration.

Figure 6:
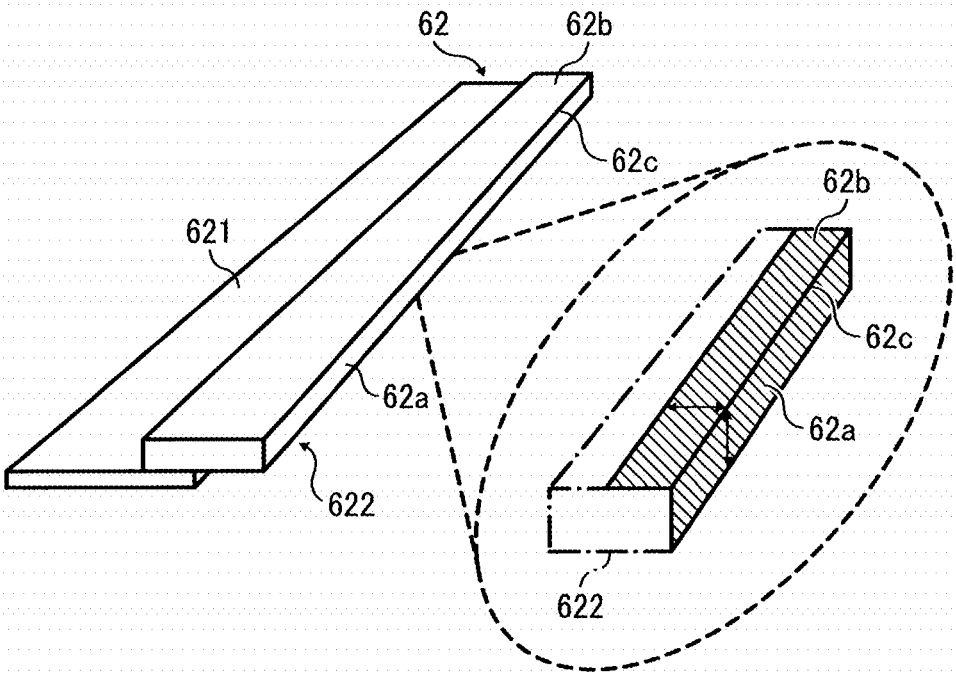
FIG. 6 is a perspective view of a cleaning blade according to an embodiment of the present invention.
Figure 7A:
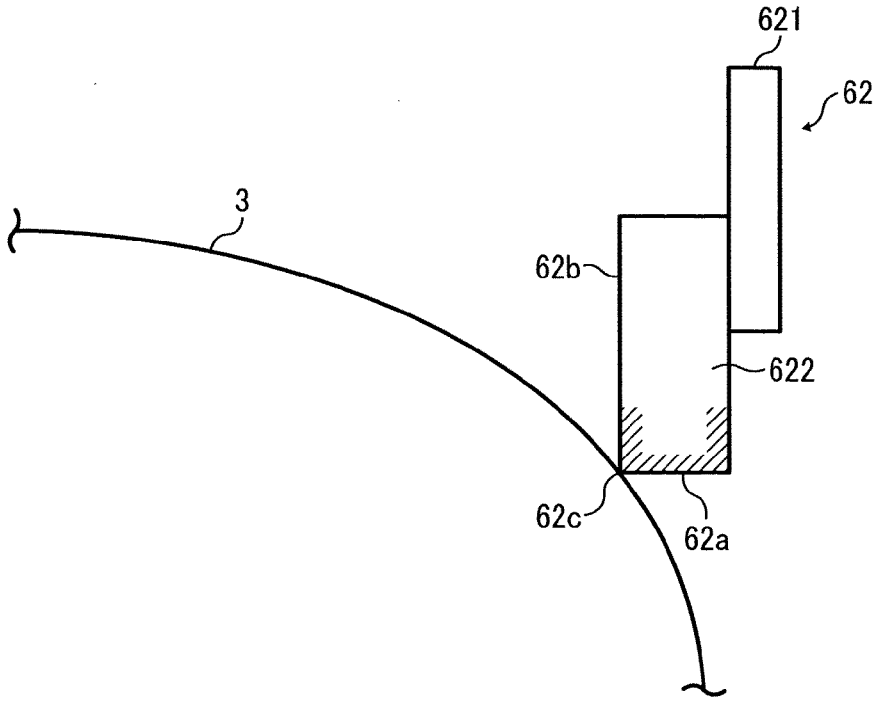
FIG. 7A is a schematic cross-sectional view of the cleaning blade illustrated in FIG. 6 in contact with the surface of a photoconductor.
Figure 7B:
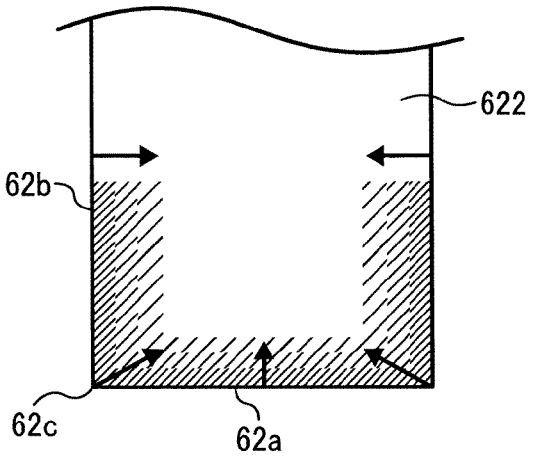
FIG. 7B is a magnified cross-sectional view of the tip ridgeline part of the cleaning blade illustrated in FIG. 6.

FIG. 6 is a perspective view of the cleaning blade 62. FIGS. 7A and 7B are magnified cross-sectional views of the cleaning blade 62. Specifically, FIG. 7A is a schematic cross-sectional view of the cleaning blade 62 in contact with the surface of the photoconductor 3. FIG. 7B is a magnified cross-sectional view of a tip ridgeline part 62*c* of the cleaning blade 62 that is a contact part with the surface of the photoconductor 3.

The cleaning blade 62 includes a holder 621 having a strip-like shape and made of a rigid material, such as metal and rigid plastic, and an elastic body blade 622 having a strip-like shape. The elastic body blade 622 has a contact part to contact the surface of the photoconductor 3. The contact part includes a cured product of an ultraviolet curable composition including an acrylate or methacrylate compound having an alicyclic structure. Referring to FIGS. 7A and 7B, the elastic body blade 622 has a blade end surface 62*a*, a blade lower surface 62*b*, and a blade upper surface. These surfaces have been subjected to an impregnation treatment in a longitudinal direction.

The elastic body blade 622 is secured to one end of the holder 621 with an adhesive. The other end of the holder 621 is supported by the casing of the cleaner 6 so that the elastic body blade 622 becomes a cantilever.

The elastic body blade 622 is preferably composed of a material having high rebound resilience so as to be able to follow eccentricity of the photoconductor 3 or micro undulation on the surface of the photoconductor 3. Specific preferred materials for the elastic body blade 622 include urethane rubber.

Urethane rubbers suitable for the elastic body blade 622 may be produced by a centrifugal molding method. Specific preferred raw materials for such urethane rubbers include polyols having 2 to 3 hydroxyl groups and an OH value of from 28 to 168, diisocyanates (e.g., TDI, MDI, IPDI, NDI, TODI), and short-chain polyols having an OH value of from 950 to 1,830 (e.g., ethylene glycol, propanediol, butanediol, pentanediol, hexanediol, glycerin, trimethylolethane, trimethylolpropane). A strip-shaped elastic body blade can be produced by mixing the above materials, pouring the resulting mixture in a centrifugal molding die having a temperature of from 100 to 200° C., releasing the molded product after a predetermined time period, leaving the product in a high-temperature high-humidity environment of 30° C., 85% RH for one week to stabilize its property, and cut the product into a desired shape.

As a curing catalyst, 2-methylimidazole and/or 1,2-dimethylimidazole can be used.

The content of the curing catalyst preferably ranges from 0.01% to 0.5% by mass, and more preferably from 0.05% to 0.3% by mass.

The elastic body blade 622 preferably includes a urethane rubber having a JIS-A hardness of from 68 to 80 degrees at 25° C. When the JIS-A hardness is in excess of 80 degrees, flexibility becomes poor. In this case, when the holder 621 is installed with a slight inclination, both ends of the cleaning blade 62 in the axial direction contact the photoconductor 3 with different contact pressures. Thus, the contact pressure becomes nonuniform in the axial direction. As a result, cleanability may deteriorate. On the other hand, when the JIS-A hardness is less than 68 degrees, the cleaning blade 62 may warp when the contact pressures is so increased that polymerization toner can be removed. As a result, the tip ridgeline part 62*c* of the cleaning blade 62 may come off the photoconductor 3, and the blade lower surface 62*b* of the cleaning blade 62 may come into contact with the photoconductor 3 instead. As a result of this phenomenon, the contact area between the cleaning blade 62 and the surface of the photoconductor 3 is rapidly enlarged, while the contact pressure of the cleaning blade 62 with the surface of the photoconductor 3 is reduced, resulting in poor cleanability. The JIS-A hardness of the elastic body blade can be measured by a micro durometer MD-1 available from Kobunshi Keiki Co., Ltd.

The elastic body blade 622 preferably has a rebound resilience, measured according to JIS-K 6255, of 35% or less, more preferably from 20% to 30%, at 23° C. When the rebound resilience is in excess of 35%, the elastic body blade may express tackiness to cause defective cleaning.

The rebound resilience can be measured by a resilience tester No. 221 available from Toyo Seiki Seisaku-sho, Ltd. according to JIS-K 6255 at 23° C.

The elastic body blade preferably has an average thickness of from 1.0 to 3.0 mm.

The elastic body blade 622 may have a two-layer structure in which two different materials are laminated on one another. Preferably, the two different materials are two different rubbers each having urethane group (i.e., urethane rubbers). Even in this case, each of the urethane rubbers preferably has a hardness within the above-described range. One of the two materials to contact the photoconductor 3 and the other material not to contact the photoconductor 3 can be properly selected. The elastic body blade 622 may also have a multilayer structure in which two or more different urethane rubbers are laminated on one another. Such an elastic body blade can be preferably produced by injecting raw materials for each layer, in each of which several materials are mixed at a different ratio, into a centrifugal molding die in a sequential manner before each layer is completely cured. The resulting layers are integrally combined without being detached from each other.

The elastic body blade 622 has a contact part to contact the surface of the photoconductor 3. The contact part includes a cured product of an ultraviolet curable composition including an acrylate or methacrylate compound having an alicyclic structure.

More specifically, the cured product of the ultraviolet curable composition may be included in either a surface region or an inner region of the contact part. In the case in which a surface layer is formed at the contact part, the cured product is included in the inner region of the contact part.

As long as the contact part of the elastic body blade 622 includes the cured product of the ultraviolet curable composition, any other part of the elastic body blade 622 may also include the cured product of the ultraviolet curable composition.

Ultraviolet Curable Composition

The ultraviolet curable composition includes an acrylate or methacrylate compound having an alicyclic structure. The ultraviolet curable composition may further optionally include other components, if needed.

Acrylate or Methacrylate Compound Having Alicyclic Structure

The acrylate or methacrylate compound having an alicyclic structure has a special bulky alicyclic structure in its molecule. Thus, the acrylate or methacrylate compound has a small functional group number and a small molecular weight. The elastic body blade is easily impregnated with such an acrylate or methacrylate compound, and therefore the contact part is effectively improved in terms of hardness. In the case in which a surface layer is formed at the contact part, the surface layer is prevented from cracking or peeling.

The acrylate or methacrylate compound having an alicyclic structure preferably has a functional group number of from 2 to 6, more preferably from 2 to 4. When the functional group number is less than 2, the hardness of the contact part may be lowered. When the functional group number is in excess of 6, steric hindrance may occur.

The acrylate or methacrylate compound having an alicyclic structure preferably has a molecular weight of 500 or less, more preferably from 250 to 400. When the molecular weight is in excess of 500, the molecular size becomes so large that the elastic body blade becomes less likely to be impregnated with the compound and it becomes more difficult to improve the hardness of the contact part.

Specific preferred examples of the acrylate or methacrylate compound having an alicyclic structure include an acrylate or methacrylate compound having a tricyclodecane structure and an acrylate or methacrylate compound having an adamantane structure. These compounds have a special cyclic structure which can cover the shortage of cross-linking points although the functional group number thereof is small.

Specific preferred examples of the acrylate or methacrylate compound having a tricyclodecane structure include, but are not limited to, tricyclodecane dimethanol diacrylate and tricyclodecane dimethanol dimethacrylate.

The acrylate or methacrylate compound having a tricyclodecane structure may be available either synthetically and commercially. Specific examples of commercially-available products of the acrylate or methacrylate compound having a tricyclodecane structure include, but are not limited to, A-DCP (available from Shin Nakamura Chemical Co., Ltd.).

Specific preferred examples of the acrylate or methacrylate compound having an adamantane structure include, but are not limited to, 1,3-adamantane dimethanol diacrylate, 1,3-adamantane dimethanol dimethacrylate, 1,3,5-adamantane trimethanol triacrylate, and 1,3,5-adamantane trimethanol trimethacrylate.

The acrylate or methacrylate compound having an adamantane structure may be available either synthetically and commercially. Specific examples of commercially-available products of the acrylate or methacrylate compound having an adamantane structure include, but are not limited to, X-DA and X-A-201 (both available from Idemitsu Kosan Co., Ltd.) and ADTM (available from Mitsubishi Gas Chemical Company, Inc.)

The content rate of the acrylate or methacrylate compound having an alicyclic structure in the ultraviolet curable composition is preferably in the range of from 20% to 100% by mass, more preferably from 50% to 100% by mass. When the content rate is less than 20% by mass, the special cyclic structure cannot sufficiently exert its ability of improving hardness.

Whether or not the acrylate or methacrylate compound having an alicyclic structure (preferably, an acrylate or methacrylate compound having a tricyclodecane structure or an acrylate or methacrylate compound having an adamantane structure) is included in the contact part of the elastic blade 622 with the photoconductor 3 can be determined by infrared microscopy or liquid chromatography.

The ultraviolet curable composition may further include an acrylate or methacrylate compound having a molecular weight of from 100 to 1,500 other than the acrylate or methacrylate compound having an alicyclic structure.

Specific examples of the acrylate or methacrylate compound having a molecular weight of from 100 to 1,500 include, but are not limited to, dipentaerythritol hexaacrylate, dipentaerythritol hexamethacrylate, pentaerythritol tetraacrylate, pentaerythritol tetramethacrylate, pentaerythritol triacrylate, pentaerythritol trimethacrylate, pentaerythritol ethoxy tetraacrylate, pentanediol ethoxy tetramethacrylate, trimethylolpropane triacrylate, trimethylolpropane trimethacrylate, trimethylolpropane ethoxy triacrylate, trimethylolpropane ethoxy trimethacrylate, 1,6-hexanediol diacrylate, 1,6-hexanediol dimethacrylate, ethoxylated bisphenol A diacrylate, ethoxylated bisphenol A dimethacrylate, propoxylated ethoxylated bisphenol A diacrylate, propoxylated ethoxylated bisphenol A dimethacrylate, 1,4-butanediol diacrylate, 1,4-butanediol dimethacrylate, 1,5-pentanediol diacrylate, 1,5-pentanediol dimethacrylate, 1,6-hexanediol diacrylate, 1,6-hexanediol dimethacrylate, 1,7-heptanediol diacrylate, 1,7-heptanediol dimethacrylate, 1,8-octanediol diacrylate, 1,8-octanediol dimethacrylate, 1,9-nonanediol diacrylate, 1,9-nonanediol dimethacrylate, 1,10-decanediol diacrylate, 1,10-decanediol dimethacrylate, 1,11-undecanediol diacrylate, 1,11-undecanediol dimethacrylate, 1,18-octadecanediol diacrylate, 1,18-octadecanediol dimethacrylate, glycerin propoxy triacrylate, glycerin propoxy trimethacrylate, dipropylene glycol diacrylate, dipropylene glycol dimethacrylate, tripropylene glycol diacrylate, tripropylene glycol dimethacrylate, PO-modified neopentyl glycol diacrylate, PO-modified neopentyl glycol dimethacrylate, PEG600 diacrylate, PEG600 dimethacrylate, PEG400 diacrylate, PEG400 dimethacrylate, PEG200 diacrylate, PEG200 dimethacrylate, neopentyl glycol hydroxypivalic acid ester diacrylate, neopentyl glycol hydroxypivalic acid ester dimethacrylate, octyl/decyl acrylate, octyl/decyl methacrylate, isobornyl acrylate, isobornyl methacrylate, ethoxylated phenyl acrylate, ethoxylated phenyl methacrylate, 9,9-bis[4-(2-acryloyloxy ethoxy)phenyl]fluorene, and 9,9-bis[4-(2-methacryloyloxy ethoxy)phenyl]fluorene. Each of these compounds can be used alone or in combination with others. Among these compounds, compounds having a pentaerythritol triacrylate structure and a functional group number of from 3 to 6 are preferable.

Specific examples of the compounds having a pentaerythritol triacrylate structure and a functional group number of from 3 to 6 include, but are not limited to, pentaerythritol triacrylate and dipentaerythritol hexaacrylate.

Other Components

Other components which may be included in the ultraviolet curable composition include, for example, a photopolymerization initiator, a polymerization inhibitor, and a diluent.

Photopolymerization Initiator

The photopolymerization initiator generates an active species, such as a radical and a cation, by optical energy to initiate a polymerization. Examples of the photopolymerization initiator include, but are not limited to, photoradical polymerization initiators and photocationic polymerization initiators. In particular, photoradical polymerization initiators are more preferable.

Specific examples of the photoradical polymerization initiators include, but are not limited to, aromatic ketones, acylphosphine oxide compounds, aromatic onium salt compounds, organic peroxides, thio compounds (e.g., thioxanthone compounds, thiophenyl-group-containing compounds), hexaaryl biimidazole compounds, ketoxime ester compounds, borate compounds, azinium compounds, metallocene compounds, active ester compounds, compounds having carbon-halogen bond, and alkylamine compounds.

Specific examples of the photoradical polymerization initiators include, but are not limited to, acetophenone, acetophenone benzyl ketal, 1-hydroxycyclohexyl phenyl ketone, 2,2-dimethoxy-2-phenyl acetophenone, xanthone, fluorenone, benzaldehyde, fluorene, anthraquinone, triphenylamine, carbazole, 3-methyl acetophenone, 4-chlorobenzophenone, 4,4'-dimethoxybenzophenone, 4,4'-diaminobenzophenone, Michler's ketone, benzoin propyl ether, benzoin ethyl ether, benzyl dimethyl ketal, 1-(4-isopropylphenyl)-2-hydroxy-2-methylpropane-1-one, 2-hydroxy-2-methyl-1-phenylpropane-1-one, thioxanthone, diethyl thioxanthone, 2-isopropyl thioxanthone, 2-chloro thioxanthone, 2-methyl-1-[4-(methylthio)phenyl]-2-morpholino-propane-1-one, bis(2,4,6-trimethylbenzoyl)-phenyl phosphine oxide, 2,4,6-trimethylbenzoyl-diphenyl-phosphine oxide, 2,4-diethylthioxanthone, and bis-(2,6-dimethoxybenzoyl)-2,4,4-trimethyl pentyl phosphine oxide. Each of these compounds can be used alone or in combination with others.

Specific examples of commercially-available products of the photoradical polymerization initiator include, but are not limited to: IRGACURE 651, IRGACURE 184, DAROCUR 1173, IRGACURE 2959, IRGACURE 127, IRGACURE 907, IRGACURE 369, IRGACURE 379, DARPCUR TPO, IRGACURE 819, IRGACURE 784, IRGACURE OXE 01, IRGACURE OXE 02, and IRGACURE 754 (available from Ciba Specialty Chemicals Inc.); SpeedCure TPO (available from Lambson); KAYACURE DETX-S (available from Nippon Kayaku Co., Ltd.); Lucirin® TPO, LR8893, and LR8970 (available from BASF); and UBECRYL P36 (available from UCB). Each of these compounds can be used alone or in combination with others.

The content rate of the photopolymerization initiator in the ultraviolet curable composition is preferably in the range of from 1% to 20% by mass.

Polymerization Inhibitor

Specific examples of the polymerization inhibitor include, but are not limited to: phenol compounds, such as p-methoxyphenol, cresol, t-butyl catechol, di-t-butyl para-crezol, hydroquinone monomethyl ether, α-naphthol, 3,5-di-t-butyl-4-hydroxytoluene, 2,2'-methylenebis(4-methyl-6-t-butylphenol), 2,2'-methylenebis(4-ethyl-6-butylphenol), and 4,4'-thiobis(3-methyl-6-t-butylphenol); quinone compounds, such as p-benzoquinone, anthraquinone, naphthoquinone, phenanthraquinone, p-xyloquinone, p-toluquinone, 2,6-dichloroquinone, 2,5-diphenyl-p-benzoquinone, 2,5-diacetoxy-p-benzoquinone, 2,5-dicaproxy-p-benzoquinone, 2,5-diacyloxy-p-benzoquinone, hydroquinone, 2,5-di-butyl hydroquinone, mono-t-butyl hydroquinone, monomethyl hydroquinone, and 2,5-di-t-amyl hydroquinone; amine compounds, such as phenyl-β-naphthylamine, p-benzylaminophenol, di-β-naphthyl para-phenylenediamine, dibenzyl hydroxyl amine, phenyl hydroxyl amine, and diethyl hydroxyl amine; nitro compounds, such as dinitrobenzene, trinitrotoluene, and picric acid; oxime compounds, such as quinone dioxime and cyclohexanone oxime; and sulfur compounds, such as phenothiazine. Each of these compounds can be used alone or in combination with others.

Diluent

Specific examples of the diluent include, but are not limited to: hydrocarbon solvents, such as toluene and xylene; ester solvents, such as ethyl acetate, n-butyl acetate, methyl cellosolve acetate, and propylene glycol monomethyl ether acetate; ketone solvents, such as methyl ethyl ketone, methyl isobutyl ketone, diisobutyl ketone, cyclohexanone, and cyclopentanone; ether solvents, such as ethylene glycol monomethyl ether, ethylene glycol monoethyl ether, and propylene glycol monomethyl ether; and alcohol solvents, such as ethanol, propanol, 1-butanol, isopropyl alcohol, and isobutyl alcohol. Each of these compounds can be used alone or in combination with others.

Specific methods for including the cured product of an ultraviolet curable composition including an acrylate or methacrylate compound having an alicyclic structure in the contact part of the elastic body blade include, but are not limited to, the following methods (1) to (3).

(1) A method in which the contact part of the elastic body blade is impregnated with the ultraviolet curable composition by means of brush coating or dip coating, and ultraviolet light is emitted to the contact part to cure the ultraviolet curable composition.

(2) A method in which the contact part of the elastic body blade is impregnated with the ultraviolet curable composition by means of brush coating or dip coating and further spray-coated with the ultraviolet curable composition to form a surface layer, and ultraviolet light is emitted to the contact part to cure the ultraviolet curable composition.

(3) A method in which the contact part of the elastic body blade is impregnated with the ultraviolet curable composition by means of brush coating or dip coating, ultraviolet light is emitted to the contact part to cure the ultraviolet curable composition, and the contact part is further spray-coated with the ultraviolet curable compositicin to form a surface layer.

Among the above methods, the method (1) is preferable.

Preferably, ultraviolet light is emitted under the condition that the integrated light quantity becomes 500 to 5,000 mj/cm$^2$.

The contact part of the elastic body blade including the cured product of the ultraviolet curable composition including the acrylate or methacrylate compound having an alicyclic structure (preferably, an acrylate or methacrylate compound having a tricyclodecane structure or an acrylate or methacrylate compound having an adamantane structure) has a high hardness. Therefore, the contact part is suppressed from turning up or deforming. Even when the inside of the elastic body blade becomes exposed as the blade wears with time, the contact part is suppressed from turning up or deforming since the inside of the blade has been impregnated with the cured product.

Preferably, the cured product is included in the entire blade end surface 62*a* and the blade lower surface 62*b* of the elastic body blade 622. With respect to the blade lower surface 62*b*, the cured product may be included over the range corresponding to the free end (e.g., the end part having no plate on the back, depending on the shape of the blade in use) of the elastic body blade 622. Preferably, the cured product is included in a range extending from the tip ridgeline part 62*c* for about 5 mm on the blade lower surface 62*b*.

The blade upper surface, opposite to the blade lower surface 62*b*, may or may not include the cured product. In the case in which the elastic body blade 622 is impregnated with the cured product by means of dipping, the blade upper surface is also impregnated with the cured product. In the case in which the elastic body blade 622 is dipped in the cured product with the tip ridgeline part 62*c* facing downward, the cured product is not included in the blade upper surface side. Even in this case, the effect of the present invention is exerted.

Preferably, the part of the elastic body blade including the cured product ranges from the surface of thereof to a depth of from 50 to 300 μm.

The thickness of that part including the cured product can be determined by analyzing a cross-section of the elastic body blade with microscopic infrared spectrometry.

The elastic body blade 622 may have a surface layer.

The surface layer can be formed by means of spray coating and dip coating. The surface layer is for covering the tip ridgeline part 62*c*, blade lower surface 62*b*, and blade upper surface of the elastic body blade 622. The surface layer preferably includes a material having a higher hardness than the elastic body blade 622. A material having a higher harness than the elastic body blade 622 is less abradable by the photoconductor than the elastic body blade 622. Thus, in the case in which the surface layer includes such a material having a higher harness than the elastic body blade 622, the cleaning blade provides an improved abrasion resistance compared to the case in which the elastic body blade 622 is directly contacting the surface of the photoconductor. Since the surface layer is less deformable for its high hardness and rigidity, the tip ridgeline part 62*c* of the cleaning blade is suppressed from turning up.

The surface layer is preferably composed of a resin, in particular, an ultraviolet curable resin. A low-cost cleaning blade having a surface layer having a desired hardness can be easily produced by just attaching the ultraviolet curable resin to the tip ridgeline part of the blade and emitting ultraviolet light thereto.

The ultraviolet curable resin is preferably produced from a monomer having a pentaerythritol triacrylate backbone (hereinafter "pentaerythritol triacrylate backbone material") having a functional group number of from 3 to 6 and a functional-group-equivalent molecular weight of 350 or less. When the functional-group-equivalent molecular weight is in excess of 350 or materials other than the pentaerythritol triacrylate backbone material is used, the resulting surface layer may become too brittle. As the surface layer becomes brittle, the tip ridgeline part 62*c* of the cleaning blade 62 easily turns up and abrasion of the blade end surface 62*a* is caused. It becomes more difficult to maintain cleanability for an extended period of time. Preferably, the surface layer further includes an acrylate material having a functional-group-equivalent molecular weight of from 100 to 1,000 and a functional group number of 1 or 2 in combination with the pentaerythritol triacrylate backbone material. In this case, flexibility is given to the surface layer. The property of the surface layer can be properly adjusted depending on the property of the machine on which the cleaning blade is to be mounted. It is also possible to improve environmental property by finely adjusting the blade behavior under a specified environment, e.g., when abnormal noise is generated.

All or part of the material composing the surface layer may be identical to the impregnation material. When the material composing the surface layer and the impregnation material are identical, adhesive strength between these materials is improved. Thus, the surface layer is suppressed from peeling off.

On the blade lower surface 62*b* or the blade end surface 62*a*, the surface layer preferably has a thickness of from 0.5 to 2 μm. When the thickness is less than 0.5 μm, rigidity of the surface layer is poor. As a result, the tip ridgeline part 62*c* of the cleaning blade 62 easily turns up. When the thickness is in excess of 2 μm, toner particles are more likely to pass through the cleaning blade 62, resulting in defective cleaning of the image bearer. The surface layer is formed by means of spray coating or dip coating in which a liquid material is attached to the cleaning blade 62, as described above. However, it is difficult to form a coating on the tip ridgeline part 62*c* due to the action of surface tension. Therefore, the thickness of the surface layer increases as the distance from the tip ridgeline part 62*c* increases. When the thickness is in excess of 2 μm, it means that the angle of the tip ridgeline part 62*c* of the cleaning blade 62 becomes more obtuse since the difference in surface layer thickness at between the tip ridgeline part 62*c* and a position apart therefrom becomes larger. As the angle of the tip ridgeline part 62*c* becomes more obtuse, the gap formed between the blade end surface 62*a* and the photoconductor 3 at an upstream side from the contact part becomes narrower compared to the case in which the tip ridgeline part 62*c* has a right angle. When toner particles have been accumulated in such a narrow gap as a result of a long-term cleaning operation, the toner particles are gradually pushed out of the gap toward a downstream side of the photoconductor since there is no escape route for the accumulated toner particles, resulting in defective cleaning.

In the case in which an ultraviolet curable resin is used for the surface layer, the elastic body blade made of urethane rubber is impregnated with the ultraviolet curable resin by means of dip coating and further spray-coated with the ultraviolet curable resin for forming the surface layer. Thereafter, the ultraviolet curable resin is cured by irradiation with ultraviolet light. Alternatively, the elastic body blade impregnated with the ultraviolet curable resin may be irradiated with ultraviolet light before the surface layer is formed thereon. In this case in which the elastic body blade impregnated with the ultraviolet curable resin is irradiated with ultraviolet light before the surface layer is formed thereon, the impregnation state of the ultraviolet curable resin to urethane rubber becomes so stable that the impregnation state never change even after the ultraviolet curable resin for forming the surface layer is applied thereon. Thus, an elastic body blade with a desired impregnation state is obtained.

Having generally described this invention, further understanding can be obtained by reference to certain specific examples which are provided herein for the purpose of illustration only and are not intended to be limiting. In the descriptions in the following examples, the numbers represent mass ratios in parts, unless otherwise specified.

EXAMPLES

Preparation of Toner 1

Preparation of Colorant Dispersion Liquid

A carbon black dispersion liquid was prepared as follows.

First, 20 parts of a carbon black (REGAL 400 from Cabot Corporation) and 2 parts of a colorant dispersant (AJISPER PB821 from Ajinomoto Fine-Techno Co., Inc.) were primarily dispersed in 78 parts of ethyl acetate using a mixer having stirrer blades. The resulting primary dispersion liquid was subjected to a dispersion treatment using a DYNOMILL to more finely disperse the carbon black and completely remove aggregations by application of a strong shearing force. The resulting secondary dispersion liquid was filtered with a polytetrafluoroethylene (PTFE) filter (Fluoropore™ Membrane Filter FHLP09050 available from Nihon Millipore K.K.) having a pore size of 0.45 μm to further disperse the carbon black to submicron order. Thus, a carbon black dispersion liquid was prepared.

Preparation of Toner Composition Liquid

First, 20 parts of a wax 1, serving as the release agent, and 263.3 parts of a polyester resin A having a glass transition temperature (Tg) of 60° C., serving as the binder resin, were mixed and dissolved in 676.7 parts of ethyl acetate using a mixer having stirrer blades at 40° C. Both the wax 1 and the polyester resin A were dissolved in the ethyl acetate without causing phase separation, and a transparent liquid was obtained. Further, 100 parts of the carbon black dispersion liquid were mixed therein and stirred for 10 minutes. Thus, a toner composition liquid was prepared.

The wax 1 is a synthetic ester wax (available from NOF CORPORATION) having a melting point of 75.2° C. and a recrystallization temperature of 64.3° C. and soluble in ethyl acetate at 40° C. at a rate of 4.4%.

The polyester resin A is a binder resin composed of terephthalic acid, isophthalic acid, and neopentyl glycol, having a weight average molecular weight (Mw) of 65,000.

The weight average molecular weight (Mw) of the binder resin were determined by subjecting THF solubles in the binder resin to a measurement by a gel permeation chromatographic apparatus GPC-150C (available from Waters Corporation) equipped with Shodex® Columns KF801-807 (available from Showa Denko K.K.) and a refractive index (RI) detector.

The boiling point of ethyl acetate is 76.8° C.

Preparation of Toner

A toner was prepared from the above-obtained toner composition liquid using the toner manufacturing apparatus illustrated in FIG. 9 having the liquid droplet discharge device illustrated in FIG. 8 as follows. First, liquid droplets of the toner composition liquid were discharged. The liquid droplets were dried and solidified by a liquid droplet solidification device using dry nitrogen. The solidified particles were collected by a cyclone collector and fan-dried at 35° C., 90% RH for 48 hours and at 40°, 50% RH for 24 hours. Thus, mother toner particles were obtained.

The toner composition liquid and the members of the toner manufacturing apparatus which contact the toner composition liquid were temperature-controlled to 40° C.

Toner Preparation Conditions

Longitudinal length (L) of liquid column resonance liquid chamber: 1.85 mm

Diameter of discharge hole outlet: 8.0 μm

Drying temperature (nitrogen): 60° C.

Drive frequency: 340 kHz

Applied voltage to piezoelectric body: 10.0 V

Next, 100.0 parts of the mother toner particles were subjected to an external treatment by being mixed with 2.0 parts of a hydrophobized silica (H2000 from Clariant Japan K.K.) using a HENSCHEL MIXER (from Mitsui Mining & Smelting Co., Ltd.). Thus, a toner 1 was prepared.

The toner 1 was embedded in an epoxy resin and cut into ultrathin sections with an ultrasonic microtome. After being dyed with $RuO_4$, the ultrathin sections were observed with a transmission electron microscope (TEM). The obtained image was analyzed using an image analysis software program ImageJ to determine the longest length Lmax of a wax domain and the maximum Feret Diameter Df of the toner particle which contains the wax domain.

The content of the wax was determined by converting the endothermic quantity of the toner 1 measured by a differential scanning calorimetry (DSC). The amount of the wax existing in a surface region ranging from the surface to 0.3 μm in depth of the toner 1 was determined by an attenuated total reflection infrared spectroscopy (ATR-FTIR).

The particle size of the toner was also measured.

Preparation of Toner 2

The procedure for preparing the toner composition liquid of the toner 1 was repeated except that the wax 1 was replaced with a wax 2, the dissolving temperature was adjusted to 50° C., and the toner composition liquid and the members of the toner manufacturing apparatus which contact the toner composition liquid were temperature-controlled to 50° C. Thus, a toner 2 was prepared.

The wax 2 is a synthetic amide wax (available from NOF CORPORATION) having a melting point of 67.4° C. and a recrystallization temperature of 60.5° C. and soluble in ethyl acetate at 50° C. at a rate of 9.5%.

Preparation of Toner 3

The procedure for preparing the toner composition liquid of the toner 1 was repeated except for replacing the wax 1 with a wax 3. Thus, a toner 3 was prepared.

The wax 3 was a synthetic ester wax (available from NOF CORPORATION) having a melting point of 71.7° C. and a recrystallization temperature of 64.5° C. and soluble in ethyl acetate at 40° C. at a rate of 3.9%.

Preparation of Toner 4

The procedure for preparing the toner composition liquid of the toner 1 was repeated except for replacing the wax 1 with a wax 4. Thus, a toner 4 was prepared.

The wax 4 was a synthetic ester wax (available from Nippon Seiro Co., Ltd.) having a melting point of 70.3° C. and a recrystallization temperature of 64.1° C. and soluble in ethyl acetate at 40° C. at a rate of 3.6%.

Preparation of Comparative Toner 1

The procedure for preparing the toner 1 was repeated except that the drying temperature was changed from 60° C. to 55° C. Thus, a comparative toner 1 was prepared.

Preparation of Comparative Toner 2

The procedure for preparing the toner 2 was repeated except that the wax 2 was not dissolved but dispersed in the ethyl acetate. Preparation of Wax Dispersion Liquid In a vessel equipped with stirrer blades and a thermometer, 20 parts of the wax 2 and 80 parts of ethyl acetate were heated to 60° C. and stirred for 20 minutes to dissolve the wax 2 in the ethyl acetate, followed by rapid cooling to precipitate fine particles of the wax 2. The resulting dispersion liquid was subjected to a dispersion treatment using a STAR MILL LMZ06 (from Ashizawa Finetech Ltd.) filled with zirconia beads having a diameter of 0.3 μm at a rotation speed of 1,800 rpm to more finely dispersed the wax. Thus, a wax 2 dispersion liquid, in which the average particle diameter was 0.3 μm and the maximum particle diameter was 0.8 μm, was prepared. The particle size of the wax was measured by an instrument NPA-150 from Microtrac, Inc.

Preparation of Toner Composition Liquid

After dissolving 263.3 parts of the polyester resin A, serving as the binder resin, in 636.7 parts of ethyl acetate, 100 parts of the wax 2 dispersion liquid and 100 parts of the carbon black dispersion liquid were mixed therein at 30° C. using a mixer having stirrer blades. Thus, a toner composition liquid was prepared.

The procedure for preparing the toner 2 was repeated except that the toner composition liquid was replaced with that prepared above, the dissolving temperature was changed to 50° C. to 30° C., and the drying temperature was changed from 60° C. to 40° C. Thus, a comparative toner 2 was prepared.

Preparation of Carrier

A mixture of 100 parts of a silicone resin (organo straight silicone), 100 parts of toluene, 5 parts of γ-(2-aminoethyl) aminopropyl trimethoxysilane, and 10 parts of a carbon black was subjected to a dispersion treatment for 20 minutes using a HOMOMIXER to prepare a coating layer forming liquid. The coating layer forming liquid was applied to the surfaces of 1,000 parts of spherical magnetite particles having a particle diameter of 50 μm using a fluidized-bed coating device. Thus, a magnetic carrier was prepared.

Preparation of Developer

Each of the above prepared toners 1 to 4 and comparative toners 1 and 2 in an amount of 4 parts was mixed with the magnetic carrier in an amount of 96.0 parts using a ball mill. Thus, two-component developers were prepared.

Evaluations

Measurement of Particle Diameter and Particle Size Distribution

The volume average particle diameter (Dv) and number average particle diameter (Dn) of each toner was measured by a particle size analyzer MULTISIZER III (from Beckman Coulter, Inc.) with setting the aperture diameter to 50 μm. The volume and number of toner particles are measured first, and then the volume distribution and number distribution are calculated. The volume average particle diameter (Dv) and number average particle diameter (Dn) are determined from the volume distribution and number distribution, respectively. The ratio (Dv/Dn) of the volume average particle diameter (Dv) to the number average particle diameter (Dn) is an indicator of particle size distribution. When the particle size distribution is monodisperse, the ratio (Dv/Dn) becomes 1. The greater the ratio (Dv/Dn), the wider the particle size distribution.

TABLE 1

| Toner | Wax | Melting Point (° C.) | Recrystallization Temp. (° C.) | Polyemer | Liquid Temp. (° C.) | Drying Temp. (° C.) | Dv (μm) | Dv/Dn | Model Diameter (μm) | Second Peak Diameter (μm) | Wax Content Rate (%) | Surface Wax Abundunce Ratio (%) | Lmax (μm) | Df (μm) |
|---|---|---|---|---|---|---|---|---|---|---|---|---|---|---|
| Toner 1 | Wax 1 | 75.2 | 64.3 | Polyester A | 40 | 60 | 5.3 | 1.10 | 4.8 | 6.0 | 6.1 | 3.3 | 6.3 | 5.1 |
| Toner 2 | Wax 2 | 67.4 | 60.5 | Polyester A | 50 | 60 | 5.2 | 1.09 | 4.8 | 6.2 | 6.2 | 1.5 | 7.1 | 5.3 |
| Toner 3 | Wax 3 | 71.7 | 64.5 | Polyester A | 40 | 60 | 5.3 | 1.09 | 4.9 | 6.1 | 6.4 | 2.6 | 6.5 | 5.2 |
| Toner 4 | Wax 4 | 70.3 | 64.1 | Polyester A | 40 | 60 | 5.4 | 1.12 | 4.9 | 6.0 | 6.3 | 3.5 | 8.1 | 5.2 |
| Comparative Toner 1 | Wax 1 | 75.2 | 64.3 | Polyester A | 40 | 55 | 5.6 | 1.08 | 4.8 | 6.0 | 6.3 | 4.2 | 2.3 | 5.1 |
| Comparative Toner 2 | Wax 2 (Dispersed) | 62.6 | 52.7 | Polyester A | 30 | 40 | 5.3 | 1.25 | 4.8 | 6.7 | 6.2 | 5.2 | 2.1 | 5.0 |

Elastic Body Blade

The following two urethane rubbers were used for preparing elastic body blades. Urethane rubber 1, having a Martens hardness of 0.8 N/mm$^2$ at 25° C., available from Toyo Tire & Rubber Co., Ltd.

Urethane rubber 2, having a two-layer structure, the contact surface side thereof having a Martens hardness of 1.5 N/mm$^2$ and the other side having Martens hardness of 0.6 N/mm$^2$ at 25° C., available from Toyo Tire & Rubber Co., Ltd.

Martens hardness of the urethane rubbers were measured with an indentation load of 1 mN for an indentation time of 10 sec.

Preparation of Ultraviolet Curable Composition 1

An ultraviolet curable composition 1 was prepared by a routine procedure using the following components: 100 parts of tricyclodecane dimethanol diacrylate represented by the following formula (1) (available from Shin Nakamura Chemical Co., Ltd. under the trade name of A-DCP, having a functional group number of 2 and a molecular weight of 304); 2 parts of a polymerization initiator (IRGACURE 184 available from Ciba Specialty Chemicals Inc.); and 25 parts of a solvent (cyclohexanone).

Formula (1)

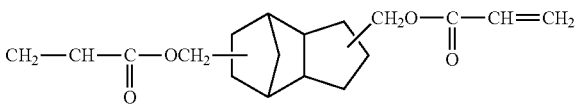

Preparation of Ultraviolet Curable Composition 2

An ultraviolet curable composition 2 was prepared by a routine procedure using the following components: 100 parts of an acrylate or methacrylate compound 1 having an adamantane structure represented by the following formula (2) (available from Idemitsu Kosan Co., Ltd. under the trade name of X-DA, being a reaction product of 1,3-adamantanediol with acrylic acid, having a functional group number of 2 and a molecular weight of from 276 to 304); 2 parts of a polymerization initiator (IRGACURE 184 available from Ciba Specialty Chemicals Inc.); and 25 parts of a solvent (cyclohexanone).

Formula (2)

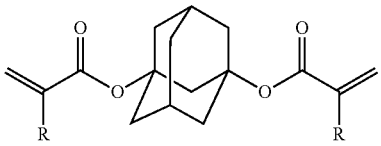

(R = H, $CH_3$)

Preparation of Ultraviolet Curable Composition 3

An ultraviolet curable composition 3 was prepared by a routine procedure using the following components: 100 parts of an acrylate or methacrylate compound 2 having an adamantane structure represented by the following formula (3) (available from Idemitsu Kosan Co., Ltd. under the trade name of X-A-201, being 1,3-adamantane dimethanol diacrylate, having a functional group number of 2 and a molecular weight of 304); 2 parts of a polymerization initiator (IRGACURE 184 available from Ciba Specialty Chemicals Inc.); and 25 parts of a solvent (cyclohexanone).

Formula (3)

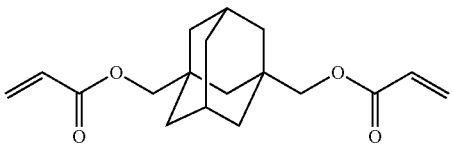

Preparation of Ultraviolet Curable Composition 4

An ultraviolet curable composition 4 was prepared by a routine procedure using the following components: 100 parts of an acrylate or methacrylate compound 3 having an adamantane structure represented by the following formula (4) (available from Mitsubishi Gas Chemical Company, Inc. under the trade name of DIAPURESTE ADTM, being 1,3,5-adamantane trimethanol triacrylate, having a functional group number of 3 and a molecular weight of 388); 5 parts of a polymerization initiator (IRGACURE 184 available from Ciba Specialty Chemicals Inc.); and 55 parts of a solvent (cyclohexanone).

Formula (4)

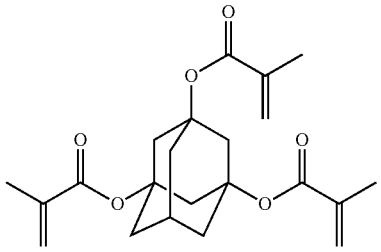

Preparation of Ultraviolet Curable Composition 5

An ultraviolet curable composition 5 was prepared by a routine procedure using the following components: 50 parts of tricyclodecane dimethanol diacrylate represented by the formula (1) (available from Shin Nakamura Chemical Co., Ltd. under the trade name of A-DCP, having a functional group number of 2 and a molecular weight of 304); 50 parts of pentaerythritol triacrylate represented by the following formula (5) (available from DAICEL-ALLNEX LTD. under the trade name of PETIA, having a functional group number of 3 and a molecular weight of 298); 2 parts of a polymerization initiator (IRGACURE 184 available from Ciba Specialty Chemicals Inc.); and 25 parts of a solvent (cyclohexanone).

Formula (5)

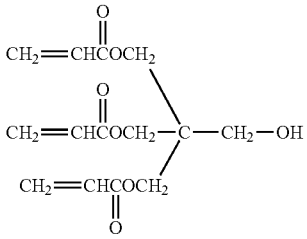

Preparation of Ultraviolet Curable Composition 6

An ultraviolet curable composition 6 was prepared by a routine procedure using the following components: 50 parts of an acrylate or methacrylate compound 2 having an adamantane structure represented by the formula (3) (available from Idemitsu Kosan Co., Ltd. under the trade name of X-A-201, being 1,3-adamantane dimethanol diacrylate, having a functional group number of 2 and a molecular weight of 304); 50 parts of pentaerythritol triacrylate represented by the formula (5) (available from DAICEL-ALLNEX LTD. under the trade name of PETIA, having a functional group number of 3 and a molecular weight of 298); 2 parts of a polymerization initiator (IRGACURE 184 available from Ciba Specialty Chemicals Inc.); and 25 parts of a solvent (cyclohexanone).

Preparation of Ultraviolet Curable Composition 7

An ultraviolet curable composition 7 was prepared by a routine procedure using the following components: 100 parts of pentaerythritol triacrylate represented by the formula (5) (available from DAICEL-ALLNEX LTD. under the trade name of PETIA, having a functional group number of 3 and a molecular weight of 298); 2 parts of a polymerization initiator (IRGACURE 184 available from Ciba Specialty Chemicals Inc.); and 25 parts of a solvent (cyclohexanone).

Preparation of Cleaning Blade 1

One leading end of the urethane rubber 1, to be brought into contact with latent image bearer, was dipped in the liquid ultraviolet curable composition 1 to a depth of 2 mm for 15 minutes. After removing the residue with a foamed sponge, the urethane rubber 1 was irradiated with ultraviolet light (176 W/cm×54 cm/min×2 passes) emitted from an ultraviolet irradiator (ECS-1511U available from EYE GRAPHICS CO., LTD.). The urethane rubber 1 was then dried by a heat dryer having an inside temperature of 100° C. for 15 minutes.

The urethane rubber 1, the surface of which had been cured, was secured to a platy holder, serving as a support, with an adhesive. Thus, a cleaning blade 1 was prepared.

Preparation of Cleaning Blades 2 to 10

The procedure for preparing the cleaning blade 1 was repeated except for replacing the urethane rubber 1 and ultraviolet curable composition 1 in accordance with formulations listed in Table 2. Thus, cleaning blades 2 to 10 were prepared.

The urethane rubber 2 having a two-layer structure is a lamination of two types of rubbers having different properties. One of the rubbers having a contact part (e.g., a tip ridgeline part) with latent image bearer has a higher hardness than the other rubber.

TABLE 2

| | Urethane Rubber | | | | Ultraviolet Curable Composition | | | | |
|---|---|---|---|---|---|---|---|---|---|
| | | | JIS-A | Rebound | | | | | |
| Cleaing Blade | No. | Structure | Hardness (degrees) | Resilience (%) | No. | Polymerizable Monomer 1 | Polymerizable Monomer 2 | Polymerization Initiator | Solvent |
| Cleaing Blade 1 | 1 | Single-layer | 68 | 30 | 1 | Tricyclodecane dimethanol diacrylate | N/A | IRGACURE 184 | Cyclohexanone |
| Cleaing Blade 2 | 1 | Single-layer | 68 | 30 | 2 | Acrylate or methacrylate compound 1 having an adamantane structure | N/A | IRGACURE 184 | Cyclohexanone |
| Cleaing Blade 3 | 1 | Single-layer | 68 | 30 | 3 | Acrylate or methacrylate compound 2 having an adamantane structure | N/A | IRGACURE 184 | Cyclohexanone |
| Cleaing Blade 4 | 1 | Single-layer | 68 | 30 | 4 | Acrylate or methacrylate compound 3 having an adamantane structure | N/A | IRGACURE 184 | Cyclohexanone |
| Cleaing Blade 5 | 1 | Single-layer | 68 | 30 | 5 | Tricyclodecane dimethanol diacrylate | Pentaerythritol triacrylate | IRGACURE 184 | Cyclohexanone |
| Cleaing Blade 6 | 1 | Single-layer | 68 | 30 | 6 | Acrylate or methacrylate compound 2 having an adamantane structure | Pentaerythritol triacrylate | IRGACURE 184 | Cyclohexanone |
| Cleaing Blade 7 | 2 | Two-layer | 80 + 75 | 25 | 1 | Tricyclodecane dimethanol diacrylate | N/A | IRGACURE 184 | Cyclohexanone |
| Cleaing Blade 8 | 2 | Two-layer | 80 + 75 | 25 | 2 | Acrylate or methacrylate compound 1 having an adamantane structure | N/A | IRGACURE 184 | Cyclohexanone |
| Cleaing Blade 9 | 1 | Single-layer | 68 | 30 | | | N/A | | |
| Cleaing Blade 10 | 1 | Single-layer | 68 | 30 | 7 | Pentaerythritol triacrylate | N/A | IRGACURE 184 | Cyclohexanone |

Examples 1 to 17 and Comparative Examples 1 to 7

Each combination of a developer and a cleaning blade listed in Table 3 was set in a color multifunction peripheral IMAGIO MP C5001, IMAGIO NEO C600, or IMAGIO NEO 455 (all available from Ricoh Co., Ltd.), serving as the image forming apparatus illustrated in FIG. 1, to perform the following evaluations.

Evaluation of Cold Offset Resistance

Each combination of a developer and a cleaning blade in accordance with Examples 1 to 17 and Comparative Examples 1 to 7 was set in a commercially-available copier IMAGIO NEO C600 (available from Ricoh Co., Ltd.). A rectangular image having sides with lengths of 3 cm and 5 cm was formed on an A4-size paper sheet (T6000 700 W machine direction, available from Ricoh Co., Ltd.) at a position 5 cm away from the leading edge of the sheet at a toner deposition amount of 0.85 mg/cm$^2$, thus preparing a toner sample. The toner sample was fixed on the sheet while controlling the fixing member to have a temperature of 120° C. and a linear speed of 300 mm/sec. The toner deposition amount was calculated from the mass difference of the sheet before and after the image formation.

The image was visually observed to determine whether offset had occurred or not at 120° C. Cold offset resistance was evaluated based on the following criteria.

A+: Cold offset had not occurred.

A: The number of portions where cold offset had slightly occurred was 3 or less.

B: The number of portions where cold offset had slightly occurred was greater than 3.

C: Cold offset had occurred.

Evaluation of Hot Offset Resistance

Each combination of a developer and a cleaning blade in accordance with Examples 1 to 17 and Comparative Examples 1 to 7 was set in a commercially-available copier IMAGIO NEO C600 (available from Ricoh Co., Ltd.). A rectangular image having sides with lengths of 3 cm and 5 cm was formed on multiple A4-size paper sheets (T6000 700 W machine direction, available from Ricoh Co., Ltd.) at a position 5 cm away from the leading edge of each of the sheets at a toner deposition amount of 0.85 mg/cm$^2$, thus preparing multiple toner samples. Each toner sample was fixed on each sheet at a different fixing temperature. The offset temperature was defined as a temperature at which the image glossiness had decreased or offset had occurred, when the fixing temperature was varied in an incremental manner.

Hot offset resistance was evaluated based on the following criteria.

A: The offset temperature was 200° C. or more.

C: The offset temperature was less than 200° C.

Evaluation of Image Stability

Each combination of a developer and a cleaning blade in accordance with Examples 1 to 17 and Comparative Examples 1 to 7 was set in a commercially-available copier IMAGIO NEO 455 (available from Ricoh Co., Ltd.). A running test in which an image chart having an image area ratio of 7% is continuously printed on 50,000 sheets of a paper TYPE 6000 (from Ricoh Co., Ltd.) was conducted. Image stability was evaluated in terms of image quality (i.e., image density, thin-line reproducibility, background fouling) of the 50,000th image based on the following criteria.

A: The 50,000th image was equivalent to the initial image in terms of image quality.

B: The 50,000th image had been changed from the initial image with acceptable level in terms of image quality, thin-line reproducibility, and/or background fouling.

C: The 50,000th image had been significantly changed from the initial image in terms of image quality, thin-line reproducibility, and/or background fouling, which was beyond the acceptable level.

Evaluation of Stick-Slip Phenomenon

Each cleaning blade was cut into a 20-cm length piece. Each piece was rubbed with a platy image bearer while being observed with a high-speed camera to determine whether stick-slip phenomenon had occurred or not. An image was developed on the image bearer by a cascade developing method. Detailed measurement conditions were as follows.

Biting amount: 0.8 mm

Contact angle: 20°

Image bearer moving speed: 0.1 mm/s

Target toner amount: 0.45 mg/cm$^2$

Evaluation Criteria

A: On the image, the tip ridgeline part of the blade never moved.

B: On the image, some parts of the tip ridgeline part of the blade had tuned up to cause stick-slip phenomenon.

C: On the image, stick-slip phenomenon had occurred at all parts of the tip ridgeline part of the blade.

Evaluation of Cleanability

Each combination of a developer and a cleaning blade in accordance with Examples 1 to 17 and Comparative Examples 1 to 7 was set in a commercially-available color multifunction peripheral IMAGIO MP C5001 (available from Ricoh Co., Ltd.). An image chart having an image area ratio of 5% was printed on 2,500 sheets of an A4-size paper in the lateral direction under a printing condition of 3 prints/job and an environmental condition of 21° C., 65% RH. The image bearer was observed to determine whether fouling had occurred or not. Cleanability was evaluated based on the following criteria.

A: Abnormal images, which may cause defective cleaning, had not been generated.

B: Abnormal images, such as unwanted lines, had been generated in part.

C: Abnormal images, such as unwanted lines and bands, had been generated significantly.

Adherence Resistance

Each combination of a developer and a cleaning blade in accordance with Examples 1 to 17 and Comparative Examples 1 to 7 was set in a commercially-available color multifunction peripheral IMAGIO NEO C5001 (available from Ricoh Co., Ltd.). After printing white image on 10,000 sheets of paper, the photoconductor and the sheets having white image thereon (hereinafter "white sheets") were visually observed.

This experiment was conducted under an environmental condition of 30° C., 80% RH.

Evaluation Criteria

A: No toner adherence was observed on both the photoconductor and the white sheets.

B: Toner adherence was slightly observed when the photoconductor was tilted. It was impossible to remove the adhered toner by rubbing it with a piece of waste cloth. No toner adherence was observed on the white sheets.

C: Toner adherence was clearly observed on both the photoconductor and the white sheets. It was impossible to remove the adhered toner by rubbing it with a piece of waste cloth.

The evaluation results of Examples and Comparative Examples are shown in Table 3.

TABLE 3

| | Toner No. | Cleaning Blade No. | Cold Offset Resistance | Hot Offet Resistance | Image Stability | Stick-Slip Phenomenon | Cleanability | Adherence Resistance |
|---|---|---|---|---|---|---|---|---|
| Example 1 | 1 | 1 | A+ | A | A | A | A | A |
| Example 2 | 1 | 2 | A+ | A | A | A | A | A |
| Example 3 | 1 | 3 | A+ | A | A | A | A | A |
| Example 4 | 1 | 4 | A+ | A | A | A | A | A |
| Example 5 | 1 | 5 | A+ | A | A | A | A | A |
| Example 6 | 1 | 6 | A+ | A | A | A | A | A |
| Example 7 | 1 | 7 | A+ | A | A | A | A | A |
| Example 8 | 1 | 8 | A+ | A | A | A | A | A |
| Example 9 | 2 | 1 | A+ | A | A | A | A | A |
| Example 10 | 2 | 5 | A+ | A | A | A | A | A |
| Example 11 | 2 | 7 | A+ | A | A | A | A | A |
| Example 12 | 3 | 1 | A | A | A | A | A | A |
| Example 13 | 3 | 5 | A | A | A | A | A | A |
| Example 14 | 3 | 7 | A | A | A | A | A | A |
| Example 15 | 4 | 1 | A | A | A | A | A | A |
| Example 16 | 4 | 5 | A | A | A | A | A | A |
| Example 17 | 4 | 7 | A | A | A | A | A | A |
| Comparative Example 1 | Comparative 1 | 1 | B | A | A | A | A | C |
| Comparative Example 2 | Comparative 2 | 1 | C | A | C | A | A | C |

TABLE 3-continued

| | Toner No. | Cleaning Blade No. | Cold Offset Resistance | Hot Offet Resistance | Image Stability | Stick-Slip Phenomenon | Cleanability | Adherence Resistance |
|---|---|---|---|---|---|---|---|---|
| Comparative Example 3 | 1 | 9 | A+ | A | A | C | C | B |
| Comparative Example 4 | 2 | 9 | A | A | A | C | C | B |
| Comparative Example 5 | 1 | 10 | A+ | A | A | B | B | B |
| Comparative Example 6 | 2 | 10 | A | A | A | B | B | C |
| Comparative Example 7 | Comparative 1 | 9 | B | A | A | C | C | C |

Table 3 indicates that the image forming apparatuses of Examples 1 to 17, in each of which the cleaning blade includes an elastic body blade having a contact portion to contact the surface of the image bearer including a cured product of an ultraviolet curable composition including an acrylate or methacrylate compound having an alicyclic structure and the toner includes a binder resin and a release agent having a longest length Lmax being equal to or greater than 1.1 times a maximum Feret diameter Df of the toner, prevent the occurrence of stick-slip motion of the cleaning blade to suppress defective cleaning of the image bearer and formation of adhered matter on the image bearer. Table 3 also indicates that the image forming apparatuses of Examples 1 to 17 have a good combination of offset resistance and filming resistance and are capable of providing high-definition high-quality image for an extended period of time.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image bearer;

a charger to charge a surface of the image bearer;

a latent image forming device to form an electrostatic latent image on the charged surface of the image bearer;

a developing device to develop the electrostatic latent image into a toner image with a toner, the toner including a binder resin and a release agent, the release agent having a longest length Lmax in the toner, the longest length Lmax being equal to or greater than 1.1 times a maximum Feret diameter Df of the toner, a transfer device to transfer the toner image from the surface of the image bearer onto a transfer medium; and a cleaner including a cleaning blade to remove residual toner particles remaining on the surface of the image bearer by contact with the surface of the image bearer, the cleaning blade including an elastic body blade having a strip-like shape, the elastic body blade having a contact part to contact the surface of the image bearer, the contact part including a cured product of an ultraviolet curable composition including an acrylate or methacrylate compound having an alicyclic structure.

2. The image forming apparatus of claim 1, wherein the acrylate or methacrylate compound having an alicyclic structure has a functional group number of from 2 to 6.

3. The image forming apparatus of claim 1, wherein the acrylate or methacrylate compound having an alicyclic structure has a molecular weight of 500 or less.

4. The image forming apparatus of claim 1, wherein the acrylate or methacrylate compound having an alicyclic structure includes at least one of an acrylate or methacrylate compound having a tricyclodecane structure and an acrylate or methacrylate compound having an adamantane structure.

5. The image forming apparatus of claim 4, wherein the acrylate or methacrylate compound having a tricyclodecane structure includes at least one of tricyclodecane dimethanol diacrylate and tricyclodecane dimethanol dimethacrylate.

6. The image forming apparatus of claim 4, wherein the acrylate or methacrylate compound having an adamantane structure includes at least one member selected from the group consisting of 1,3-adamantane dimethanol diacrylate, 1,3-adamantane dimethanol dimethacrylate, 1,3,5-adamantane trimethanol triacrylate, and 1,3,5-adamantane trimethanol trimethacrylate.

7. The image forming apparatus of claim 1, wherein the elastic body blade includes a first rubber having urethane group and a second rubber having urethane group, the first rubber and the second rubber laminated on one another.

8. The image forming apparatus of claim 1, wherein the release agent has a melting point of 65° C. or more.

9. The image forming apparatus of claim 1, wherein the release agent includes a wax, wherein a content rate of the wax in the toner, determined by converting an endothermic quantity of the wax measured by differential scanning calorimetry (DSC) into a mass of the wax, ranges from 1% to 20% by mass, and wherein an abundance ratio of the wax in a surface region of the toner, measured by attenuated total reflection Fourier transform infrared spectroscopy (ATR-FTIR), ranges from 0.1% to 0.4% by mass, the surface region extending from the surface of the toner to 0.3 μm in depth.

10. The image forming apparatus of claim 1, wherein the toner has a volume average particle diameter of from 1 to 8 μm and a particle size distribution of from 1.00 to 1.15, the particle size distribution being a ratio of the volume average particle diameter to a number average particle diameter of the toner.

11. The image forming apparatus of claim 1, wherein the toner has a volume-based particle size distribution having a second peak particle diameter being from 1.21 to 1.31 times a model diameter.

12. A process cartridge detachably mountable on image forming apparatus, comprising:

an image bearer;

a developing device to develop an electrostatic latent image formed on a surface of the image bearer into a toner image with a toner, the toner including a binder resin and a release agent, the release agent having a longest length Lmax in the toner, the longest length Lmax being equal to or greater than 1.1 times a maximum Feret diameter Df of the toner; and a cleaner including a cleaning blade to remove residual toner particles remaining on the surface of the image bearer by contact with the surface of the image bearer, the cleaning blade including an elastic body blade having a strip-like shape, the elastic body blade having a contact part to contact the surface of the image bearer, the contact part including a cured product of an ultraviolet curable composition including an acrylate or methacrylate compound having an alicyclic structure.

* * * * *